US010890872B2

(12) United States Patent
Sakaguchi et al.

(10) Patent No.: US 10,890,872 B2
(45) Date of Patent: Jan. 12, 2021

(54) IMAGE FORMING APPARATUS

(71) Applicant: CANON KABUSHIKI KAISHA, Tokyo (JP)

(72) Inventors: Ryou Sakaguchi, Toride (JP); Tadao Sugiura, Moriya (JP); Naoko Mima, Moriya (JP); Shun Motohashi, Misato (JP); Masashi Yokoyama, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 263 days.

(21) Appl. No.: 16/151,824

(22) Filed: Oct. 4, 2018

(65) Prior Publication Data

US 2019/0113878 A1 Apr. 18, 2019

(30) Foreign Application Priority Data

Oct. 12, 2017 (JP) ..... 2017-198316

(51) Int. Cl.
*G03G 15/00* (2006.01)
*G03G 15/16* (2006.01)
*G03G 15/01* (2006.01)

(52) U.S. Cl.
CPC ..... *G03G 15/70* (2013.01); *G03G 15/0136* (2013.01); *G03G 15/1615* (2013.01); *G03G 15/5062* (2013.01); *G03G 15/6529* (2013.01)

(58) Field of Classification Search
CPC ..... G03G 15/70
USPC ..... 399/21
See application file for complete search history.

(56) References Cited

U.S. PATENT DOCUMENTS 6,029,041 A * 2/2000 Takano ..... G03G 15/6564 399/303
2004/0234280 A1* 11/2004 Matsuyama ..... G03G 15/70 399/21
2009/0279906 A1* 11/2009 Kuma ..... B65H 5/062 399/21
2015/0368056 A1* 12/2015 Murata ..... B65H 7/06 271/259
2016/0180205 A1* 6/2016 Kurohata ..... G03G 15/70 358/1.12
2016/0318731 A1* 11/2016 Kowase ..... B65H 29/12

FOREIGN PATENT DOCUMENTS

JP 2004-246571 A 9/2004
JP 5245657 B2 7/2013

* cited by examiner

*Primary Examiner* — Anthony H Nguyen
(74) *Attorney, Agent, or Firm* — Venable LLP

(57) ABSTRACT

An image forming apparatus includes a mechanism configured to bring an intermediate transfer member into a first state contacting first and second drums and a second state separating from the first drum and contacting the second drum. The image forming apparatus is operable in a first mode of using the first and second drums in the first state, a second mode of using only the second drum in the second state, and a third mode of using only the second drum in the first state. If an image forming retry involving cleaning a transfer portion due to a recording medium conveyance delay in the third mode is to be performed, a controller changes over the third mode to the second mode without stopping rotation of the second drum to perform image formation on a recording medium fed by restart of a feeding operation.

9 Claims, 22 Drawing Sheets

FIG. 11A
| | TIME |
|---|---|
| FROM K EXPOSURE POSITION TO SECONDARY TRANSFER POSITION | 0.60sec |
| FROM Y EXPOSURE POSITION TO SECONDARY TRANSFER POSITION | 1.85sec |
| FROM FIRST FEED CASSETTE TO SECONDARY TRANSFER POSITION | 1.00sec |
| FROM SECOND FEED CASSETTE TO SECONDARY TRANSFER POSITION | 1.70sec |
| FROM MANUAL FEED TRAY TO SECONDARY TRANSFER POSITION | 2.00sec |
FIG. 11B
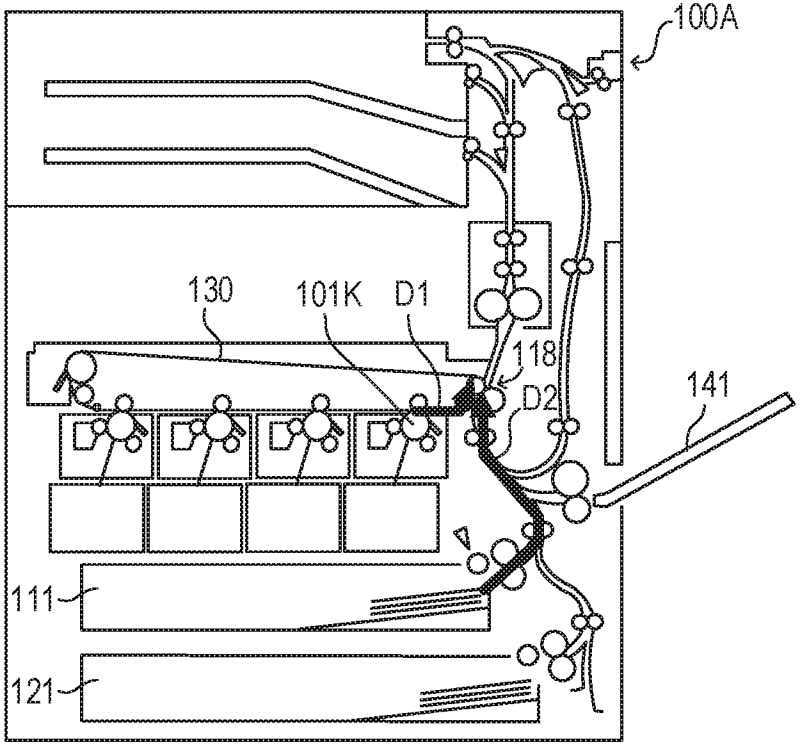
FIG. 11C
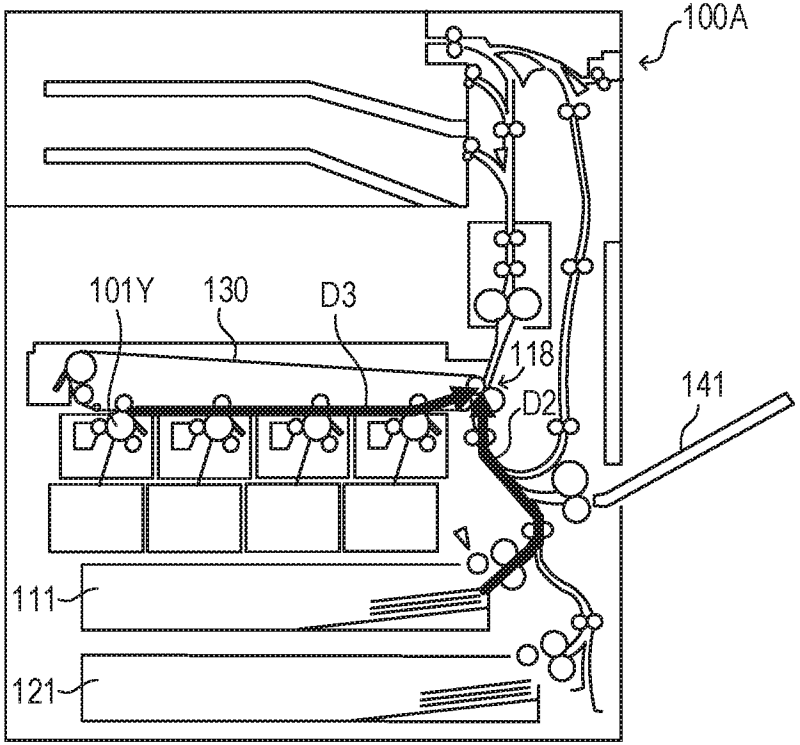

FIG. 12

| OPERATION MODE / FEEDING PORTION | MONOCHROME MODE | FULL COLOR MODE | FULL COLOR CONTACT MONOCHROME MODE |
|---|---|---|---|
| FIRST FEED CASSETTE | FEED PRECEDENCE | IMAGE FORMATION PRECEDENCE | IMAGE FORMATION PRECEDENCE |
| SECOND FEED CASSETTE | FEED PRECEDENCE | IMAGE FORMATION PRECEDENCE | IMAGE FORMATION PRECEDENCE |
| MANUAL FEED TRAY | FEED PRECEDENCE | FEED PRECEDENCE | FEED PRECEDENCE |

| FIG. 16A |
| --- |
| FIG. 16B |

| FIG. 18A |
| --- |
| FIG. 18B |

IMAGE FORMING APPARATUS

BACKGROUND OF THE INVENTION

Field of the Invention

The present invention relates to an image forming apparatus which is operable in a plurality of image forming modes.

Description of the Related Art

Hitherto, there has been known image forming apparatus such as a copying machine and a printer configured to form an image on a recording medium by an electrophotographic method. Image forming operations of the image forming apparatus include an image formation precedence type operation and a feed precedence type operation. In the image formation precedence type operation, formation of a toner image on an image bearing member is started prior to conveyance of a recording medium. In the feed precedence type operation, conveyance of a recording medium is started prior to formation of a toner image. In the image formation precedence type operation, when the conveyance of the recording medium delays due to slipping of a conveyance roller, the conveyance of the recording medium does not match a transfer timing of the toner image, with the result that the toner image cannot be transferred to the recording medium. When the conveyance delay of the recording medium is detected, the image forming apparatus displays a jam of the recording medium and stops the image forming operation. In order to prevent such stop of the image forming operation caused by the jam, according to Japanese Patent No. 5245657, when the jam occurs, the recording medium is temporarily stopped with a conveyance roller provided upstream of a transfer portion, and cleaning processing for a transfer roller is performed. After that, an image forming retry operation of re-forming a toner image and restarting the conveyance of the recording medium having been stopped is performed. The stop of the image forming operation caused by the conveyance delay of the recording medium is prevented by the image forming retry operation.

An image forming apparatus is operable in a plurality of image forming modes including a first image forming mode (full color mode) and a second image forming mode (monochrome mode). In the first image forming mode, a plurality of image bearing members on which toner images of yellow, magenta, cyan, and black are respectively formed are brought into contact with an intermediate transfer member, thereby forming a full color image. In the second image forming mode, only an image bearing member on which a black toner image is formed is brought into contact with the intermediate transfer member, thereby forming a monochromatic image. When the full color image and the monochromatic image are successively formed on recording media, changeover time for changing over the image forming mode from the first image forming mode in which four image bearing members are held in contact with the intermediate transfer member to the second image forming mode in which one image bearing member is held in contact with the intermediate transfer member is needed. In order to eliminate the need for the changeover time, according to an image forming apparatus disclosed in Japanese Patent Application Laid-Open No. 2004-246571, when a successive printing job in which a full color page and a monochromatic page are mixed is to be executed, the image forming apparatus is operable in a third image forming mode (full color contact monochrome mode). In the third image forming mode, a state in which four image bearing members are held in contact with the intermediate transfer member is maintained, and only a laser light source for black is turned on while laser light sources for yellow, magenta, and cyan are turned off, thereby forming a monochromatic image on a recording medium. With this, the need for the changeover time for changing over the image forming mode between the first image forming mode and the second image forming mode is eliminated, thereby shortening output time of the successive printing job in which a full color page and a monochromatic page are mixed.

However, in the third image forming mode, even when a monochromatic image is to be formed, the image bearing members for yellow, magenta, and cyan are rotated while being held in contact with the intermediate transfer member. Therefore, surfaces of the image bearing members are worn, with the result that a lifetime of the image bearing members is shortened. Moreover, when the conveyance delay of the recording medium occurs during the image forming operation in the third image forming mode, the image bearing members for yellow, magenta, and cyan are rotated while being held in contact with the intermediate transfer member also during the image formation performed again by the image forming retry operation. In this case, the surfaces of the image bearing members for yellow, magenta, and cyan which are not needed for formation of the monochromatic image are further worn, with the result that the lifetime of those image bearing members is further shortened.

SUMMARY OF THE INVENTION

In view of the above-mentioned circumstances, the present invention provides an image forming apparatus configured to determine, when conveyance delay of a recording medium occurs during an image forming operation in a third image forming mode, whether or not to change over an image forming mode from the third image forming mode to a second image forming mode before restarting the image formation.

According to one embodiment of the present invention, there is provided an image forming apparatus comprising:

a storage unit configured to store a recording medium;

a feeding unit configured to feed the recording medium from the storage unit;

a first photosensitive drum on which a color toner image is to be formed;

a second photosensitive drum on which a black toner image is to be formed;

an intermediate transfer member to which the color toner image and the black toner image are to be transferred;

a transfer portion configured to transfer the toner images having been transferred on the intermediate transfer member to the recording medium;

a mechanism configured to bring the intermediate transfer member into a first state in which the intermediate transfer member is in contact with the first photosensitive drum and the second photosensitive drum and a second state in which the intermediate transfer member is separated from the first photosensitive drum and in contact with the second photosensitive drum;

a detector configured to detect the recording medium fed by the feeding unit; and a controller, wherein the image forming apparatus is operable in:

a first image forming mode of bringing the intermediate transfer member into the first state and forming an image by using the first photosensitive drum and the second photosensitive drum;

a second image forming mode of bringing the intermediate transfer member into the second state and forming an image by using only the second photosensitive drum; and a third image forming mode of bringing the intermediate transfer member into the first state and forming an image by using only the second photosensitive drum, and wherein the controller is configured to:

determine an occurrence of a recording medium conveyance delay in which a recording medium is not detected by the detector within a predetermined time period;

in a case where the recording medium conveyance delay occurs, perform restarting a feeding operation by the feeding unit and perform an image forming retry involving an operation of cleaning the transfer portion; and in a case where the image forming retry is to be performed in the third image forming mode, change over the third image forming mode to the second image forming mode without stopping rotation of the second photosensitive drum and perform an image formation on a recording medium fed by restart of the feeding operation after the third image forming mode is changed over to the second image forming mode.

Further features of the present invention will become apparent from the following description of exemplary embodiments with reference to the attached drawings.

BRIEF DESCRIPTION OF THE DRAWINGS

FIG. 11A, FIG. 11B, and FIG. 11C are explanatory views for illustrating changeover between an image formation precedence type and a feed precedence type in the first embodiment.

FIG. 12 is a search table for showing changeover conditions for the image formation precedence type and the feed precedence type in the first embodiment.

DESCRIPTION OF THE EMBODIMENTS

Now, with reference to the accompanying drawings, a description will is provided of the embodiments.

First Embodiment

<Image Forming System>

Figure 1:
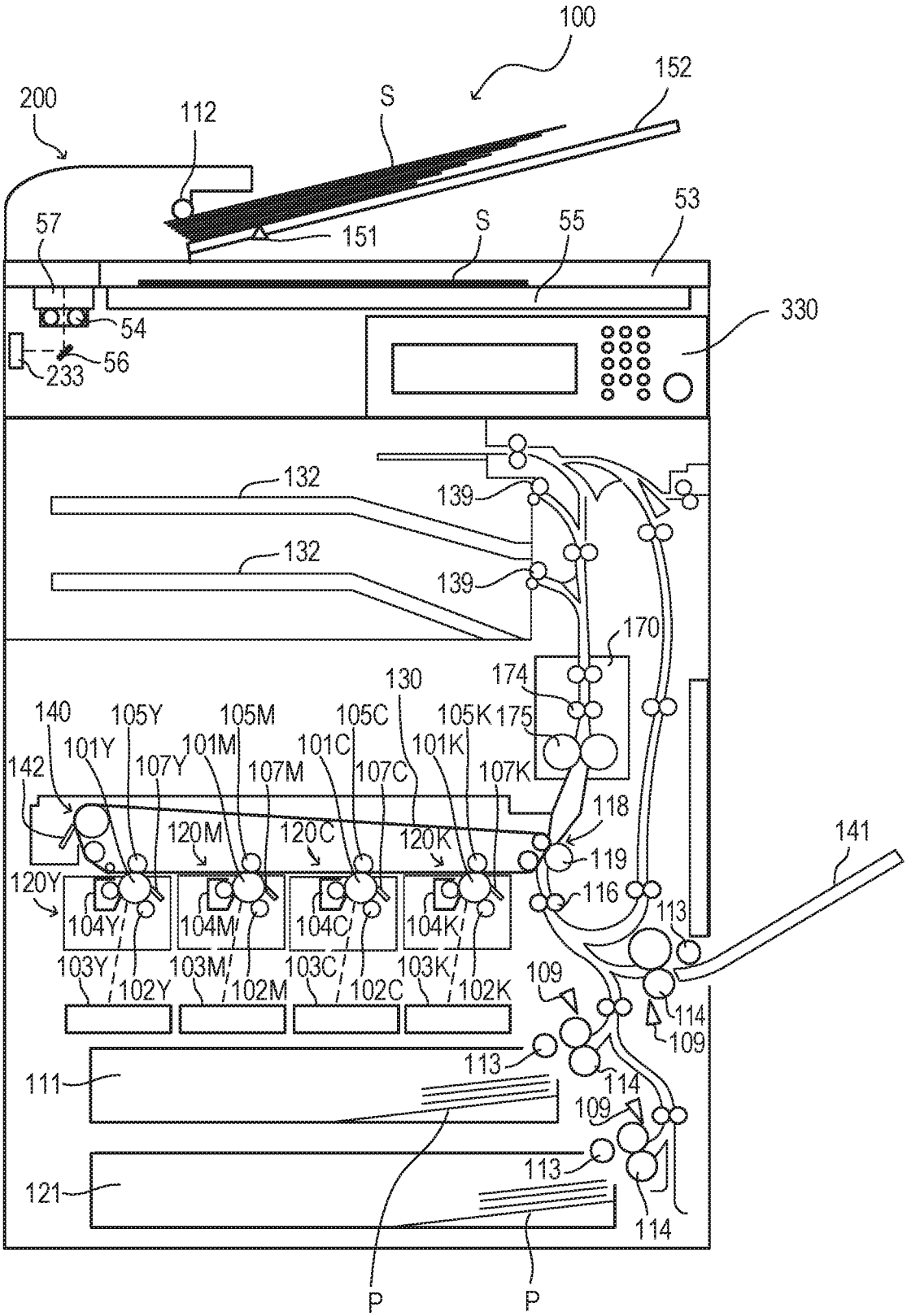
FIG. 1 is a sectional view of an image forming apparatus according to a first embodiment.
Figure 2:
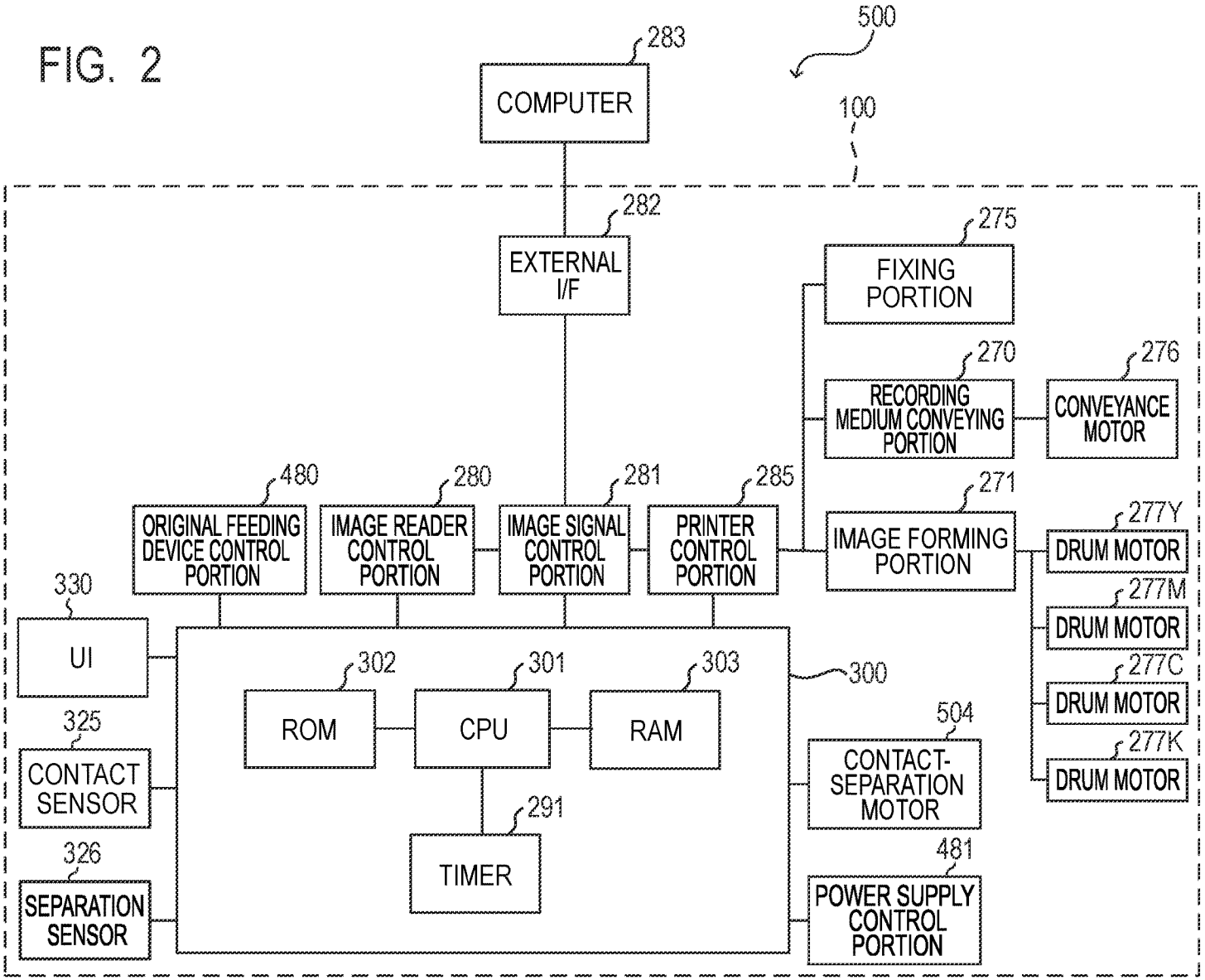
FIG. 2 is a block diagram of an image forming system in the first embodiment.

An image forming system 500 includes an image forming apparatus 100 and a computer 283. FIG. 1 is a sectional view of an image forming apparatus according to a first embodiment of the present invention. FIG. 2 is a block diagram of the image forming system 500 in the first embodiment. With reference to FIG. 1 and FIG. 2, a description will be provided of the image forming apparatus 100.

[Image Forming Apparatus]

The image forming apparatus 100 is operable in a first image forming mode (hereinafter referred to as "full color mode") of forming a full color image (color image) and a second image forming mode (hereinafter referred to as "monochrome mode") of forming a monochromatic image (single-color image). An image reader 200 is provided at an upper portion of the image forming apparatus 100. The image reader 200 includes an original tray 152, an original sensor (original detector) 151, an original conveyance roller 112, an original feeding device control portion 480, a platen glass 55, a lamp (light source) 54, a reflection mirror 56, an image sensor 233, and an image reader control portion 280. The image reader 200 includes an original pressing plate 53 configured to press an original S placed on the platen glass 55.

As illustrated in FIG. 2, the image forming apparatus 100 includes a control portion 300 being a controller. The control portion 300 includes a CPU (control circuit) 301, a ROM (storage device) 302, a RAM (storage device) 303, and a timer (time measurement device) 291. The CPU 301 is a central processing unit configured to perform system control for the image forming apparatus 100. The CPU 301 is connected to the ROM 302 and the RAM 303 by an address bus and a data bus. The ROM 302 stores a control program which is to be executed by the CPU 301. The RAM 303 stores variables which are to be used for control and image data read by the image sensor 233. The RAM 303 is a non-volatile memory configured to store data even when supply of power to the image forming apparatus 100 is stopped. The timer 291 is connected to the CPU 301. The timer 291 is configured to count time and output a count value (measurement value) to the CPU 301. The CPU 301 is configured to set a count value to the timer 291, acquire the count value from the timer 291, and clear the acquired count value.

The CPU 301 is configured to perform, through the original feeding device control portion 480, drive of the original conveyance roller 112 illustrated in FIG. 1 and detection of presence or absence of the original S on the original tray 152 with the original sensor 151. The image reader 200 is configured to perform flow reading and fixed reading of an image of an original. The CPU 301 is configured to perform, through the image reader control portion 280, detection of opening and closing operations of the original pressing plate 53 and fixed reading of an image of the original S on the plate glass 55 with the image sensor 233. The CPU 301 is configured to convey the original S on the original tray 152 to a flow-reading glass 57 with the original feeding device control portion 480, and perform flow reading of an image of the conveyed original S with the image sensor 233. An analog image signal output from the image sensor 233 is transmitted to an image signal control portion 281.

During a copying operation, the image signal control portion 281 performs various kinds of processing after converting the analog image signal from the image sensor 233 into a digital image signal, converts the digital image signal into a video signal, and outputs the video signal to a printer control portion 285. Moreover, during an image forming operation, the image signal control portion 281 performs various kinds of processing to a digital image signal input from the computer 283 through an external I/F 282, converts the digital image signal into a video signal, and outputs the video signal to the printer control portion 285. The printer control portion 285 instructs the image forming portion 271 to form an image based on an instruction from the CPU 301. The image forming portion 271 drives image forming units 120 (120Y, 120M, 120C, and 120K) based on the video signal input from the printer control portion 285. The printer control portion 285 performs conveyance control of driving the recording medium conveying portion 270 to convey a recording medium (hereinafter referred to as "sheet") based on an instruction from the CPU 301. Moreover, the printer control portion 285 performs fixing control of driving a fixing portion 275 to fix a toner image having been transferred to the sheet based on an instruction from the CPU 301.

A user interface (hereinafter referred to as "UI") 330 is an operation portion for allowing a user to operate the image forming apparatus 100. A user sets image forming conditions through the UI 330. The image forming conditions include, for example, a magnification/reduction rate, selection of a sheet, setting of an image density, simplex/duplex printing, and the number of copies. A user can select an image forming mode through the UI 330. The image forming modes include a full color mode (first image forming mode) of forming a full color image, a monochrome mode (second image forming mode) of forming a monochromatic image, and a full color/monochrome automatic determination mode. The CPU 301 stores the selected image forming mode in the RAM 303. The UI 330 is configured to display a state of the image forming apparatus 100. A user can give an instruction of copy start through the UI 330.

When the image forming operation is not performed for a predetermined time period, the CPU 301 shifts the image forming apparatus 100 to a power-saving mode through the power supply control portion 481. In the power saving mode, an LED back light of the UI 330 is turned off, and supply of power to various drive loads is stopped.

[Image Forming Operation]

Next, with reference to FIG. 1 and FIG. 2, a description will be provided of the image forming operation of the image forming apparatus 100. The CPU 301 receives a setting instruction for the image forming mode and the image forming conditions from the UI 330 or the computer 283. When placement of the original S on the original tray 152 is detected through the original feeding device control portion 480, or when the opening and closing operations of the original pressing plate 53 and placement of the original S on the platen glass 55 are detected through the image reader control portion 280, the CPU 301 starts an image formation preparing operation. In the image formation preparing operation, the CPU 301 starts fixing temperature adjustment control for a fixing device 170, and performs a contact-separation operation of the intermediate transfer unit 140 in accordance with the image forming mode set by the UI 330 or the computer 283. In the contact-separation operation, the CPU 301 changes over the state of the intermediate transfer unit 140 between a contact state (first state) and a separation state (second state) in accordance with the set image forming mode. Detailed description is made later with regard to the image formation preparing operation of the image forming apparatus 100 and the contact-separation operation of the intermediate transfer unit 140. The CPU 301 starts drive control of a motor configured to rotate a rotary polygon mirror provided in each laser scanner unit (hereinafter referred to as "light scanning device") 103 (103Y, 103M, 103C, and 103K).

A description will be provided of an example case of an image forming operation of conveying the original S placed on the original tray 152 to the flow-reading glass 57, reading an image of the original S by flow reading, and forming an image on a sheet P. When an instruction to start the image forming operation is received from the UI 330 or the computer 283, the CPU 301 drives the original conveyance roller 112 through the original feeding device control portion 480. The CPU 301 conveys the original S from the original tray 152 to the flow-reading glass 57 by the original conveyance roller 112, and causes illumination light to be emitted from the lamp 54 to the flow-reading glass 57. Reflected light from the original S is introduced to the image sensor 233 by the reflection mirror 56. Image data of the original S having been read by the image sensor 233 is output to the image signal control portion 281. After reading of an image of the last original detected by the original sensor 151 is completed, the flow-reading operation is completed. The image data is stored in the RAM 303.

When an image of the original S placed on the platen glass 55 is to be read by fixed reading, the lamp 54 and the reflection mirror 56 are moved in a sub-scanning direction under the platen glass 55. The image sensor 233 receives reflected light from the original S to read an image of the original S placed on the platen glass 55, and outputs image data to the image signal control portion 281. The image data is stored in the RAM 303.

Meanwhile, the CPU 301 changes over the state of the intermediate transfer unit 140 to the contact state or the separation state in accordance with an image forming mode. When an image formation start instruction is received from the UI 330, the CPU 301 controls the image forming units 120 (120Y, 120M, 120C, and 120K) through the image forming portion 271 to start the image forming operation in accordance with image data stored in the RAM 303. The letters Y, M, C, and K added to the reference symbols indicate configurations corresponding respectively to yellow, magenta, cyan, and black. The image forming unit 120Y is configured to form a yellow toner image. The image forming unit 120M is configured to form a magenta toner image. The image forming unit 120C is configured to form a cyan toner image. The image forming unit 120K is configured to form a black toner image. The image forming units 120Y, 120M, 120C, and 120K have the same structure except for colors of toner. Therefore, unless otherwise needed in the following description, the letters Y, M, C, and K are omitted.

The image forming unit 120 includes a photosensitive drum (image bearing member) 101, a developing device 104, a charging roller 102, and a photosensitive drum cleaner 107. The charging roller (charging member) 102 is configured to uniformly charge a surface of the photosensitive drum 101. The light scanning device (exposure device) 103 causes laser light (light beam) having been modulated in accordance with image data to be emitted to the surface of the photosensitive drum 101 having been uniformly charged, thereby forming an electrostatic latent image on the surface of the photosensitive drum 101. The developing device 104 causes the electrostatic latent image formed on the photosensitive drum 101 to be developed with toner of a corresponding color, thereby forming a toner image of the corresponding color. In the monochrome mode, a black toner image is formed only on the surface of the photosensitive drum 101K. A primary transfer roller 105K is configured to transfer the black toner image on the photosensitive drum 101K to an intermediate transfer belt (intermediate transfer member) 130. In the full color mode, a yellow toner image, a magenta toner image, a cyan toner image, and a black toner image are formed on the photosensitive drums 101Y, 101M, 101C, and 101K, respectively. Primary transfer rollers 105Y, 105M, 105C, and 105K sequentially transfer the toner images on the photosensitive drums 101Y, 101M, 101C, and 101K to the intermediate transfer belt 130 and superimpose the toner images on one another. The toner images having been transferred to the intermediate transfer belt 130 are conveyed to a secondary transfer portion 118 by rotation of the intermediate transfer belt 130.

The CPU 301 drives, through the recording medium conveying portion 270, the conveyance motor 276 being a drive source for pickup rollers 113, feed rollers 114, registration rollers 116, and delivery rollers 139. The pickup rollers 113, the feed rollers 114, and the registration rollers 116 are each conveyance means for conveying the sheet P from a storage to the secondary transfer portion 118. The sheet P is stored in each of a feed cassette 111 in a first stage on an upper side (hereinafter referred to as "first feed cassette") being a storage and a feed cassette 121 in a second stage on a lower side (hereinafter referred to as "second feed cassette") being a storage. Moreover, the sheet P is placed on a manual feed tray 141 being a storage. The CPU 301 takes the sheet P into the feed roller 114 by the pickup roller 113 from the first feed cassette 111, the second feed cassette 121, or the manual feed tray 141 in accordance with an image forming condition. The feed roller 114 being a feeding unit conveys the sheet P one after another to the registration rollers 116. The registration rollers 116 are configured to convey the sheet P to the secondary transfer portion 118 in synchronization with a timing of the toner image on the intermediate transfer belt 130. Through application of a secondary transfer voltage to the secondary transfer outer roller 119 of the secondary transfer portion 118, the toner image on the intermediate transfer belt 130 is transferred to the sheet P.

The sheet P having a toner image transferred thereto is conveyed to the fixing device 170. The fixing device 170 fixes the toner image on the sheet P by heating and pressurizing the sheet P. With this, an image is formed on the sheet P. The CPU 301 drives the delivery roller 139 through the recording medium conveying portion 270 to deliver the sheet P having an image formed thereon to the delivery tray 132 by the delivery roller 139. The image forming apparatus 100 and the image forming operation described above are examples, and the present invention is not limited to the image forming apparatus 100 and the image forming operation described above.

<Image Forming Mode>

[Setting of Image Forming Mode by Operation Portion]

Figure 3A:
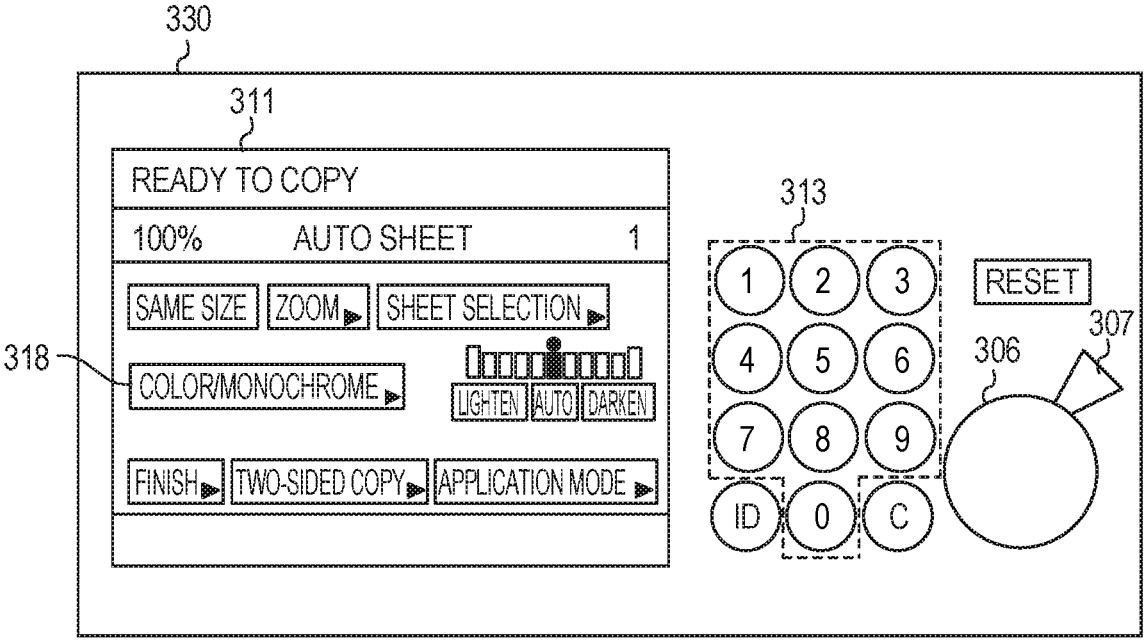
FIG. 3A and FIG. 3B are each an illustration of a UI in the first embodiment.
Figure 3B:
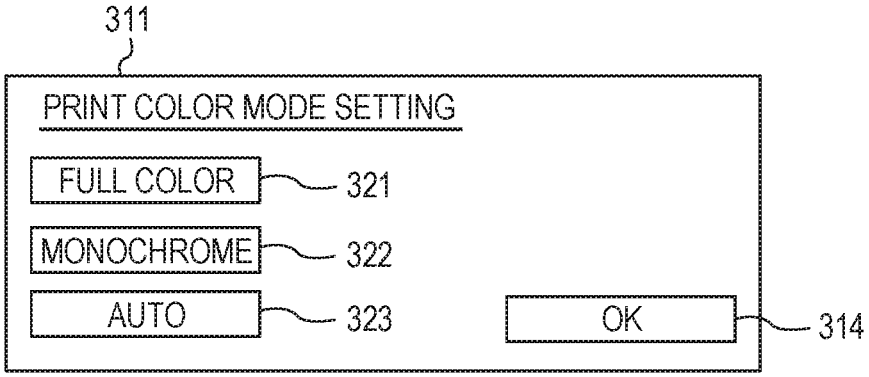

FIG. 3A and FIG. 3B are each an illustration of the UI 330 in the first embodiment. FIG. 3A is a front view of the UI 330. On the UI 330, there are arranged a start key 306 for starting a copying operation, a stop key 307 for stopping the copying operation, and numerical keys 313 for setting of numbers. Moreover, in an upper portion of the UI 330, there is arranged the display portion 311 formed of a touch panel. The display portion 311 is configured to create a software key on a screen. When a "color/monochrome" software key 318 displayed on the display portion 311 is pressed by a user, a print color mode setting screen illustrated in FIG. 3B is displayed on the display portion 311 by pop-up.

FIG. 3B is an illustration of a screen for setting a print color mode as the image forming mode. A user can set the print color mode as the image forming mode of the image forming apparatus 100 through the print color mode setting screen. The print color mode setting screen displays a full color mode key 321, a monochrome mode key 322, a full color/monochrome automatic determination mode key 323, and a color mode OK key 314. The full color mode key 321 is a software key for selecting the full color mode (first image forming mode) of forming a full color image. The monochrome mode key 322 is a software key for selecting the monochrome mode (second image forming mode) of forming a monochromatic image. The full color/monochrome automatic determination mode key 323 is a software key for selection of forming an image in an image forming mode in accordance with a determination result which is given by automatic determination of a full color image or a monochromatic image with regard to an image of the original S. The color mode OK key 314 is a key for setting the image forming mode selected by a user to the UI 330. A user selects one of the full color mode key 321, the monochrome mode key 322, and the full color/monochrome automatic determination mode key 323 and presses the color mode OK key 314 to set an image forming mode of the image forming apparatus 100. When the color mode OK key 314 is pressed, the CPU 301 stores the set image forming mode in the RAM 303. In the first embodiment, the image forming mode is set by using the UI 330. However, the image forming mode may be set with the computer 283 through the external I/F 282.

[Contact-Separation Operation of Intermediate Transfer Unit Depending on Image Forming Mode]

Next, a description will be provided of a contact-separation mechanism 400 configured to change over the state of the intermediate transfer belt 130 and the photosensitive drum 101 between the contact state and the separation state depending on the full color mode and the monochrome mode in the first embodiment.

(Photosensitive Drum and Intermediate Transfer Belt)

Figure 4A:
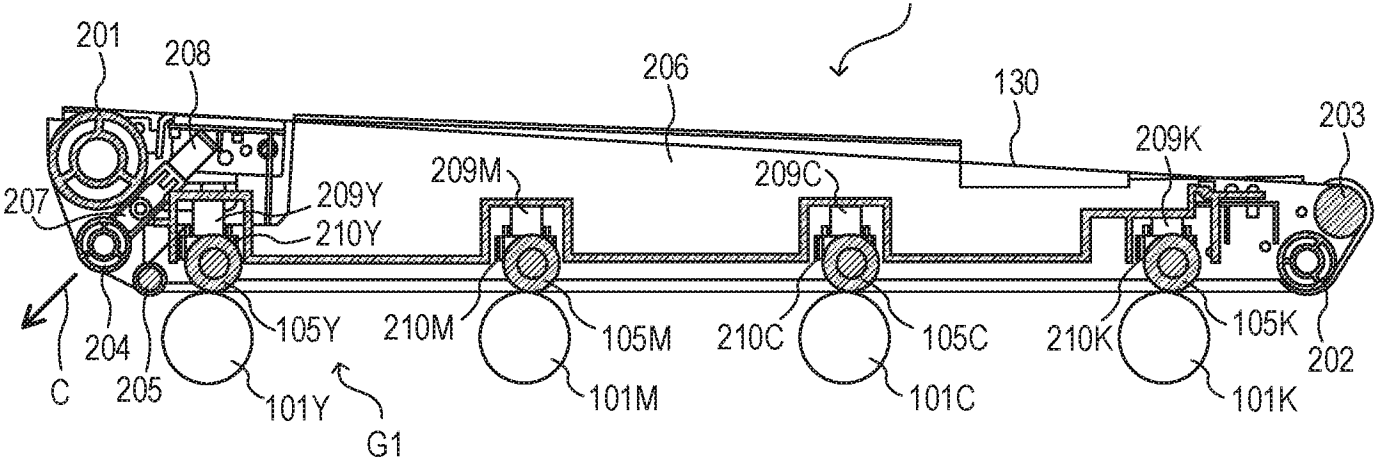
FIG. 4A and FIG. 4B are each a sectional view of an intermediate transfer unit in the first embodiment.
Figure 4B:
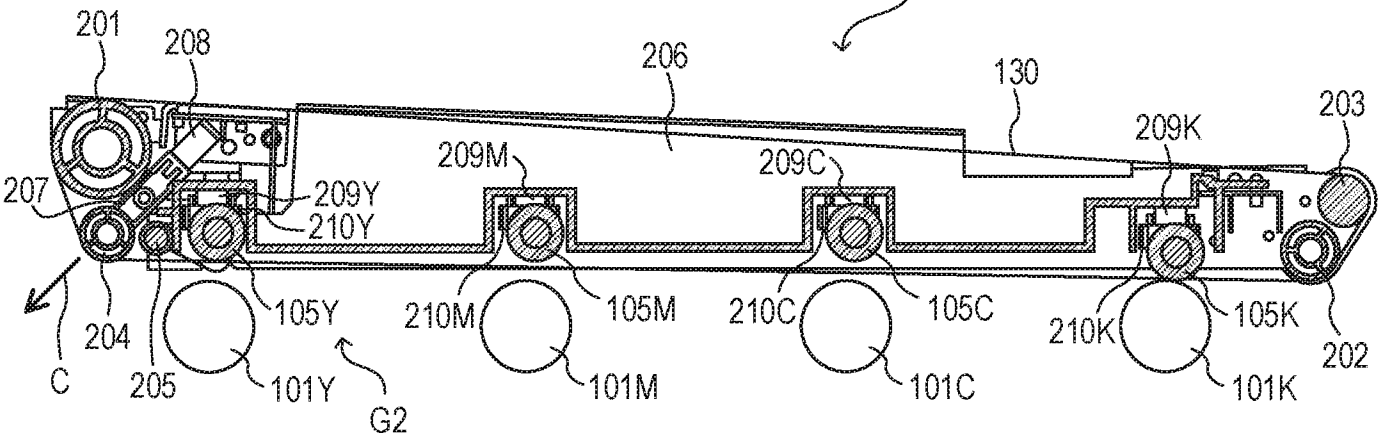

FIG. 4A and FIG. 4B are each a sectional view of the intermediate transfer unit 140 in the first embodiment. FIG.

4A is a sectional view of the intermediate transfer unit 140 in the full color mode. FIG. 4B is a sectional view of the intermediate transfer unit 140 in the monochrome mode. As illustrated in FIG. 4A, the intermediate transfer belt 130 is stretched around a drive roller 201, an idler roller 202, a secondary transfer inner roller 203, a tension roller 204, and an auxiliary roller 205. The drive roller 201 is rotated by an intermediate transfer belt motor (not shown). The intermediate transfer belt 130 is rotated by the rotation of the drive roller 201. The drive roller 201, the idler roller 202, and the secondary transfer inner roller 203 are rotatably supported on a frame 206 of the intermediate transfer unit 140. Both end portions of the tension roller 204 are rotatably supported by a bearing 207 which is movable in the direction indicated by the arrow C in FIG. 4A and FIG. 4B relative to the frame 206. The bearing 207 is urged by a movement spring 208 so as to be movable in the direction indicated by the arrow C. With this, the tension roller 204 applies a substantially constant tension to the intermediate transfer belt 130.

The primary transfer rollers 105Y, 105M, 105C, and 105K are arranged so as to be opposed to the photosensitive drums 101Y, 101M, 101C, and 101K, respectively, across the intermediate transfer belt 130. Both ends of the primary transfer rollers 105Y, 105M, 105C, and 105K are rotatably supported by bearings 210Y, 210M, 210C, and 210K, respectively. The bearings 210Y, 210M, 210C, and 210K are guided by the frame 206 so as to be movable in one direction (up-and-down direction in FIG. 4A and FIG. 4B). The bearings 210Y, 210M, 210C, and 210K are urged toward the photosensitive drums 101Y, 101M, 101C, and 101K by springs 209Y, 209M, 209C, and 209K. The photosensitive drums 101Y, 101M, 101C, and 101K are driven by drum motors 277Y, 277M, 277C, and 277K, respectively.

In the full color mode, toner images of all the colors are formed. Thus, in the full color mode, as illustrated in FIG. 4A, the primary transfer rollers 105Y, 105M, 105C, and 105K are held in contact with the photosensitive drums 101Y, 101M, 101C, and 101K through intermediation of the intermediate transfer belt 130. Color toner images are formed on surfaces of the first photosensitive drums 101Y, 101M, and 101C (color photosensitive drums). A black toner image is formed on the surface of the second photosensitive drum 101K (monochrome photosensitive drum). In the following description, a state in which the intermediate transfer belt 130 is held in contact with the first photosensitive drums 101Y, 101M, and 101C (color photosensitive drums) and the second photosensitive drum 101K (monochrome photosensitive drum) is referred to as "contact state".

In the monochrome mode, only a black toner image is formed. Thus, in the monochrome mode, as illustrated in FIG. 4B, the primary transfer rollers 105Y, 105M, and 105C of yellow, magenta, and cyan cause the intermediate transfer belt 130 to be separated from the photosensitive drums 101Y, 101M, and 101C. The drum motors 277Y, 277M, and 277C configured to drive the separated photosensitive drums 101Y, 101M, and 101C are also stopped. As illustrated in FIG. 4B, the primary transfer rollers 105Y, 105M, and 105C and the auxiliary roller 205 are retreated upward, and are not held in contact with the intermediate transfer belt 130. Moreover, the intermediate transfer belt 130 is not held in contact with the photosensitive drums 101Y, 101M, and 101C for yellow, magenta, and cyan. Only the primary transfer roller 105K for black is held in contact with the photosensitive drum 101K for black through intermediation of the intermediate transfer belt 130. In the following description, a state in which the intermediate transfer belt 130 is held in contact with only the second photosensitive drum 101K (monochrome photosensitive drum) and is separated from the first photosensitive drums 101Y, 101M, and 101C (color photosensitive drums) is referred to as "separation state".

(Contact-Separation Mechanism)

Figure 5A:
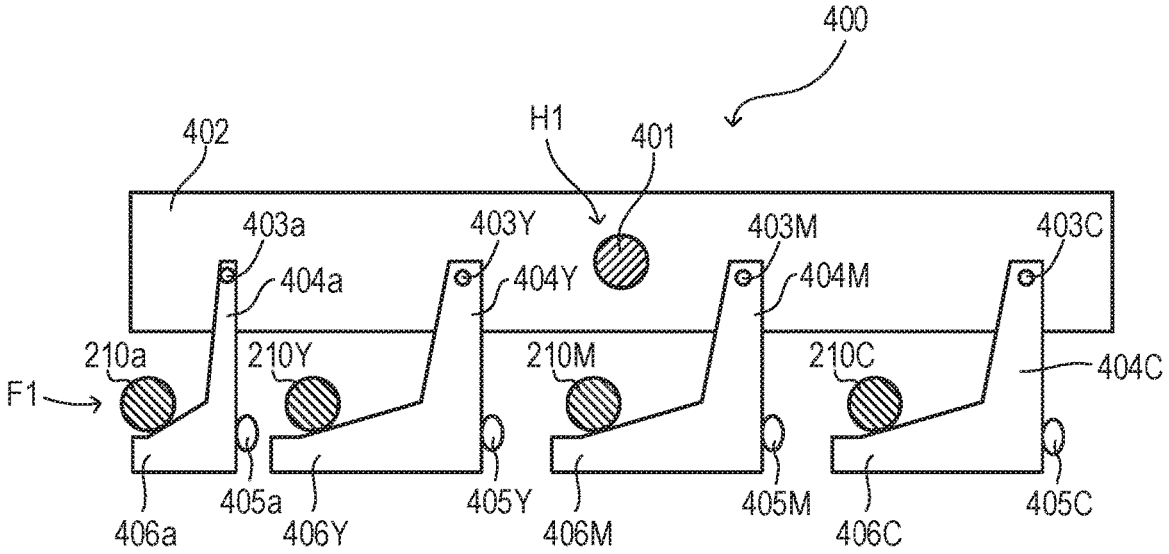
FIG. 5A and FIG. 5B are each a sectional view of a contact-separation mechanism in the first embodiment.
Figure 5B:
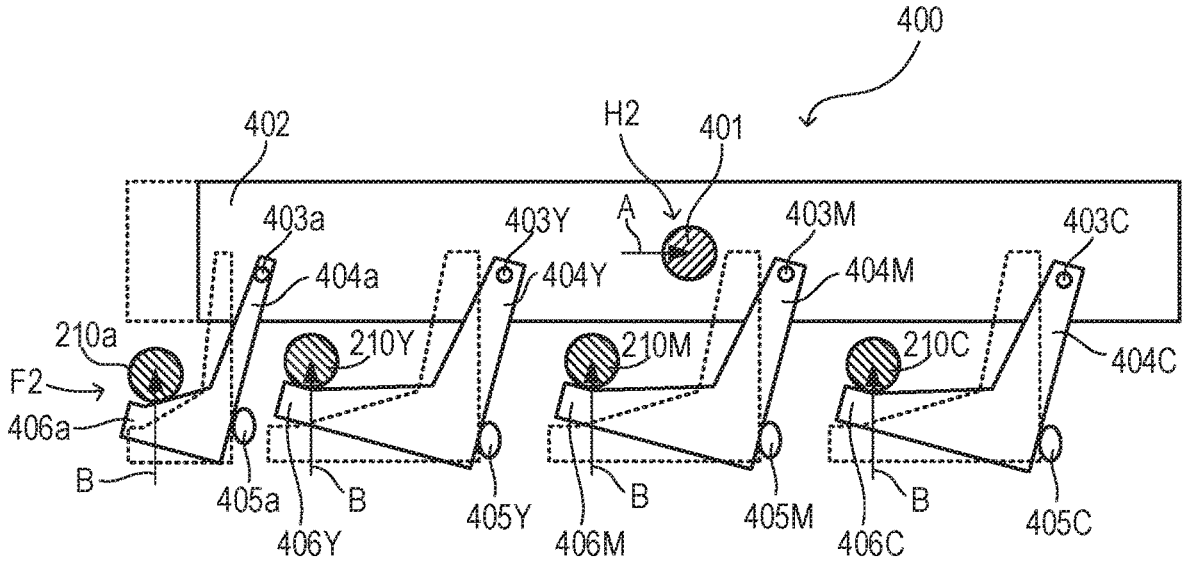

Next, with reference to FIG. 5A, FIG. 5B, FIG. 6A, FIG. 6B, FIG. 6C, FIG. 6D, FIG. 6E, FIG. 7A, and FIG. 7B, a description will be provided of the contact-separation mechanism 400 configured to change over the state of the intermediate transfer unit 140 between the contact state and the separation state. FIG. 5A and FIG. 5B are each a sectional view of the contact-separation mechanism 400 in the first embodiment. FIG. 5A is an illustration of the contact-separation mechanism 400 in the contact state of the intermediate transfer unit 140. When the contact-separation mechanism 400 is in the contact state illustrated in FIG. 5A, the intermediate transfer belt 130 is held in contact with all of the photosensitive drums 101Y, 101M, 101C, and 101K as illustrated in FIG. 4A. FIG. 5B is an illustration of the contact-separation mechanism 400 in the separation state of the intermediate transfer unit 140. When the contact-separation mechanism 400 is in the separation state illustrated in FIG. 5B, as illustrated in FIG. 4B, the intermediate transfer belt 130 is held in contact with only one photosensitive drum 101K and is separated from the photosensitive drums 101Y, 101M, and 101C.

The contact-separation mechanism 400 includes a moving member (sliding member) 402 which is movable in a direction along which the image forming units 120Y, 120M, 120C, and 120K are arrayed (direction indicated by the arrow A of FIG. 5B). FIG. 5A is an illustration of the contact-separation mechanism 400 before the moving member 402 moves (slides). FIG. 5B is an illustration of the contact-separation mechanism 400 after the moving member 402 moves in the direction indicated by the arrow A. The operation of the contact-separation mechanism 400 by the movement of the moving member 402 is described later.

First, with reference to FIG. 5A and FIG. 5B, a description will be provided of a structure of the contact-separation mechanism 400. As illustrated in FIG. 5A, a lever member 401 is fixed to the moving member 402. Lift arms 404Y, 404M, and 404C support the bearings 210Y, 210M, and 210C of the primary transfer rollers 105Y, 105M, and 105C for yellow, magenta, and cyan from below. A lift arm 404*a* supports a bearing 210*a* of the auxiliary roller 205 from below. The lift arms 404*a*, 404Y, 404M, and 404C are rotatably supported on the moving member 402 by arm shafts 403*a*, 403Y, 403M, and 403C. Lift arm support portions 405*a*, 405Y, 405M, and 405C are arranged in the vicinities of the lift arms 404*a*, 404Y, 404M, and 404C. The lift arms 404*a*, 404Y, 404M, and 404C can be brought into contact with the lift arm support portions 405*a*, 405Y, 405M, and 405C. End portions 406*a*, 406Y, 406M, and 406C of the lift arms 404*a*, 404Y, 404M, and 404C support the bearing 210*a* of the auxiliary roller 205 and the bearings 210Y, 210M, and 210C of the primary transfer rollers 105Y, 105M, and 105C, respectively.

Figure 6A:
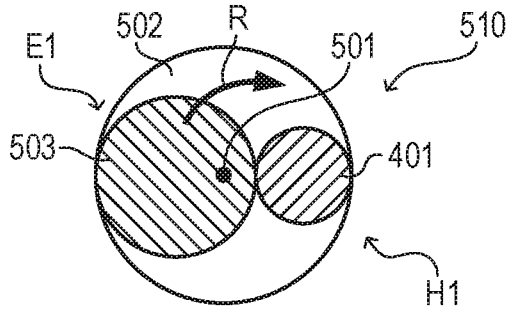
FIG. 6A, FIG. 6B, FIG. 6C, FIG. 6D, and FIG. 6E are each an illustration of a cam structure configured to move a moving member in the first embodiment.

FIG. 6A, FIG. 6B, FIG. 6C, FIG. 6D, and FIG. 6E are each an illustration of a cam structure 510 configured to move the moving member 402 in the first embodiment. The cam structure 510 is configured to move the moving member 402 in the direction indicated by the arrow A (horizontal direction in FIG. 5B) as illustrated in FIG. 5B. As illustrated in FIG. 6A, the lever member 401 fixed to the moving member 402 is arranged in contact with a cam portion 503 fixed to a gear 502. The gear 502 is rotated by a contact-separation motor (driving device) 504 (FIG. 7A and FIG. 7B) in the direction indicated by the arrow R about a cam shaft 501.

In FIG. 6A, the cam portion 503 is at a position E1 at which the cam portion 503 does not interfere with the lever member 401. When the cam portion 503 is at the position E1, the lever member 401 is at a left end position H1. When the lever member 401 is at the left end position H1, as illustrated in FIG. 5A, the bearings 210*a*, 210Y, 210M, and 210C are at a lower position F1. When the bearings 210*a*, 210Y, 210M, and 210C are at the lower position F1, the primary transfer rollers 105Y, 105M, and 105C for yellow, magenta, and cyan and the auxiliary roller 205 are at a lower position G1 as illustrated in FIG. 4A. The primary transfer rollers 105Y, 105M, 105C, and 105K are held in contact with the photosensitive drums 101Y, 101M, 101C, and 101K through intermediation of the intermediate transfer belt 130. The primary transfer rollers 105Y, 105M, 105C, and 105K are brought into the contact state of causing the intermediate transfer belt 130 to be held in contact with the photosensitive drums 101Y, 101M, 101C, and 101K.

Figure 7A:
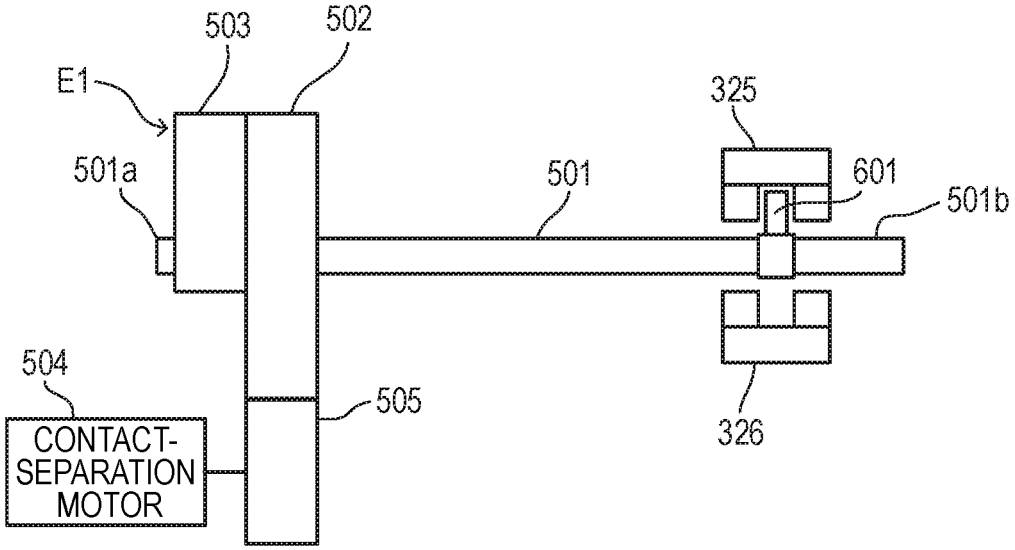
FIG. 7A and FIG. 7B are each a plan view for illustrating a gear, a cam portion, and a bearing in the first embodiment.
Figure 7B:
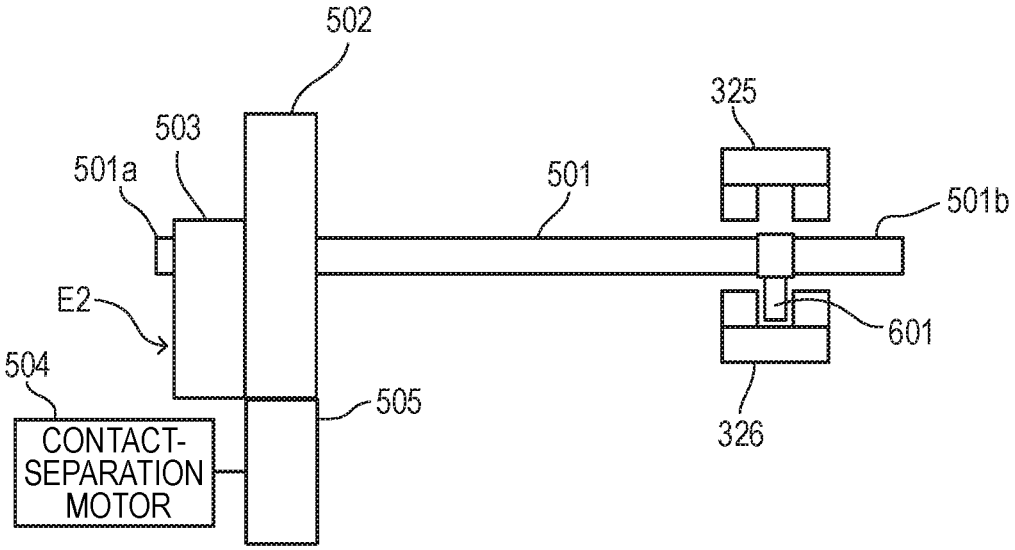

FIG. 7A and FIG. 7B are each a plan view for illustrating the gear 502, the cam portion 503, and the cam shaft 501 in the first embodiment. As illustrated in FIG. 7A, the gear 502 and the cam portion 503 are fixed to one end portion 501*a* of the cam shaft 501. A contact-separation detection flag 601 is fixed to another end portion 501*b* of the cam shaft 501. A contact sensor 325 and a separation sensor 326 are arranged so as to be opposed to each other around the contact-separation detection flag 601. As illustrated in FIG. 2, the contact sensor 325 and the separation sensor 326 are electrically connected to the CPU 301 of the control portion 300. The contact-separation motor 504 is configured to rotate the gear 502 through intermediation of a gear train 505. The gear 502 rotates integrally with the cam portion 503, the cam shaft 501, and the contact-separation detection flag 601. FIG. 7A is an illustration of the contact-separation detection flag 601 when the cam portion 503 is at the position E1. The contact-separation detection flag 601 blocks light at the contact sensor 325. The CPU 301 determines that the contact-separation mechanism 400 is in the contact state based on a detection result given by the contact sensor 325.

Figure 6B:
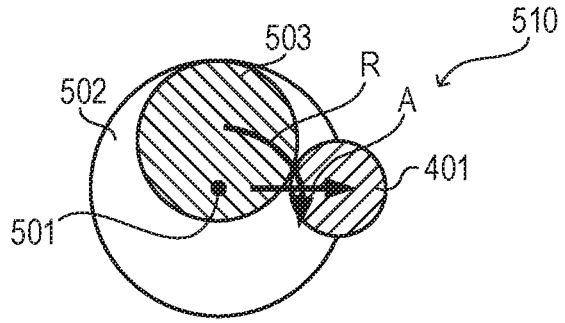

When the contact-separation motor 504 is driven, the state of the cam portion 503 and the lever member 401 is changed over from the state illustrated in FIG. 6A to the state illustrated in FIG. 6B. When the contact-separation motor 504 is driven, the cam shaft 501 is rotated, and the gear 502 is rotated along with the rotation of the cam shaft 501. FIG. 6B is an illustration of a state in which the gear 502 is rotated by 90° in the direction indicated by the arrow R by the contact-separation motor 504 from the state in FIG. 6A. As illustrated in FIG. 6B, the rotation of the gear 502 causes the cam portion 503 to push the lever member 401 in the direction indicated by the arrow A.

Figure 6C:
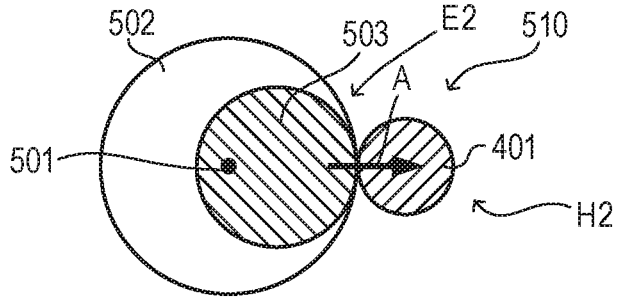

When the contact-separation motor 504 is further driven from the state of FIG. 6B, the state illustrated in FIG. 6C is attained. FIG. 6C is an illustration of a state in which the gear 502 is rotated by 180° in the direction indicated by the arrow R by the contact-separation motor 504 from the state of FIG. 6A. As illustrated in FIG. 6C, the cam portion 503 is rotated together with the gear 502 to be at the position E2. When the cam portion 503 is at the position E2, the cam portion 503 pushes the moving member 402 in the direction indicated by the arrow A to the farthest position. That is, the lever member 401 is at a right end position H2. When the lever member 401 is at the right end position H2, as illustrated in FIG. 5B, the moving member 402 is at the farthest position in the direction indicated by the arrow A.

Through the movement of the moving member 402, the moving member 402 applies a force to the arm shafts 403*a*, 403Y, 403M, and 403C of the lift arms 404*a*, 404Y, 404M, and 404C. With the arm shafts 403*a*, 403Y, 403M, and 403C as points of lever, the lift arms 404*a*, 404Y, 404M, and 404C rotate about the lift arm support portions 405*a*, 405Y, 405M, and 405C as support points. The end portions 406*a*, 406Y, 406M, and 406C of the lift arms 404*a*, 404Y, 404M, and 404C as points of action lift up the bearings 210*a*, 210Y, 210M, and 210C in the direction indicated by the arrow B. As illustrated in FIG. 5B, the bearings 210*a*, 210Y, 210M, and 210C move to an upper position F2. Thus, the primary transfer rollers 105*y*, 105*m*, and 105*c* for yellow, magenta, and cyan and the auxiliary roller 205 are pushed upward and move to the upper position G2 as illustrated in FIG. 4B. At this time, the primary transfer rollers 105Y, 105M, and 105C are not held in contact with the photosensitive drums 101Y, 101M, and 101C through intermediation of the intermediate transfer belt 130. That is, the intermediate transfer belt 130 is brought into the separation state of being in contact with only the photosensitive drum 101K (monochrome photosensitive drum) and being separated from the photosensitive drums 101Y, 101M, and 101C.

FIG. 7B is an illustration of the contact-separation detection flag 601 when the cam portion 503 is at the position E2. In FIG. 7B, the contact-separation detection flag 601 blocks light at the separation sensor 326. The separation sensor 326 outputs an ON signal to the CPU 301. Based on the ON signal from the separation sensor 326, the CPU 301 determines that the contact-separation mechanism 400 is in the separation state. The method of detecting contact and separation and the structure which are described above are examples, and the present invention is not limited to the method and the structure described above.

Figure 6D:
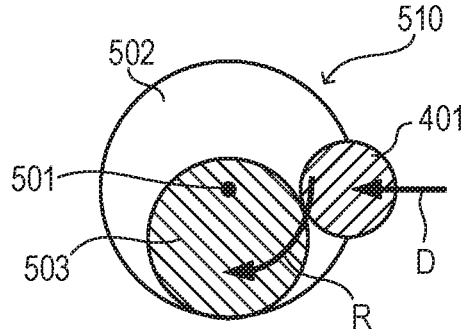

When the contact-separation motor 504 is further driven from the state of FIG. 6C, the state illustrated in FIG. 6D is attained. FIG. 6D is an illustration of a state in which the gear 502 is rotated by 270° in the direction indicated by the arrow R by the contact-separation motor 504 from the state of FIG. 6A. The lever member 401 moves in the direction indicated by the arrow D which is opposite to the direction indicated by the arrow A by the own weight of the primary transfer rollers 105Y, 105M, and 105C and the auxiliary roller 205 and by application of the urging force by the springs 209Y, 209M, 209C, and 209K.

Figure 6E:
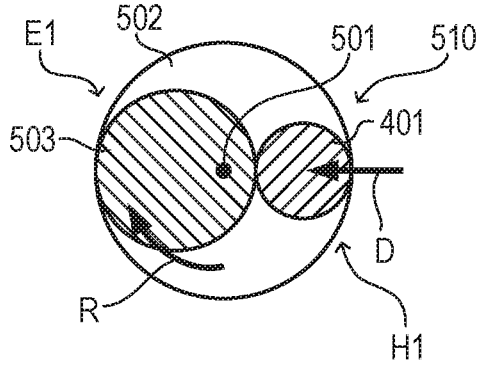

When the contact-separation motor 504 is further driven from the state of FIG. 6D, the state illustrated in FIG. 6E is attained. FIG. 6E is an illustration of a state in which the gear 502 is rotated by 360° in the direction indicated by the arrow R by the contact-separation motor 504 from the state of FIG. 6A. The state of FIG. 6E is the same as the state of FIG. 6A. The cam portion 503 is at the position E1, and the lever member 401 is at the left end position H1, and hence the intermediate transfer belt 130 returns to the contact state of being in contact with the photosensitive drums 101Y, 101M, 101C, and 101K (full color photosensitive drum).

The contact-separation mechanism 400 described above is an example, and the present invention is not limited to the contact-separation mechanism 400 described above. As described above, with the configuration of bringing the contact-separation mechanism 400 into the separation state in the monochrome mode, wear of the surfaces of the photosensitive drums 101Y, 101M, and 101C due to friction of the photosensitive drums 101Y, 101M, and 101C with the intermediate transfer belt 130 can be reduced. With this, as compared to the case in which the intermediate transfer belt 130 is held in contact with the photosensitive drums 101Y, 101M, and 101C, the lifetime of the photosensitive drums 101Y, 101M, and 101C can be extended. Moreover, with the configuration of stopping the drive of the drum motors 277Y, 277M, and 277C corresponding respectively to the photosensitive drums 101Y, 101M, and 101C, the amount of power consumption is reduced, thereby achieving power saving of the image forming apparatus 100.

(Full Color Contact Monochrome Mode)

In a case of forming a monochromatic image successively after a full color image, when the state of the contact-separation mechanism 400 is changed over from the contact state to the separation state, the changeover operation of the contact-separation mechanism 400 takes long time, with the result that a printing speed is reduced. Therefore, in order to reduce the frequency of the changeover operation which may cause reduction in printing speed, in the case of forming a monochromatic image successively after a full color image in the first embodiment, the monochromatic image is formed in a third image forming mode (hereinafter referred to as "full color contact monochrome mode"). That is, in the case of forming a monochromatic image successively after a full color image, without changing over the state of the contact-separation mechanism 400 from the contact state to the separation state, the monochromatic image is formed in the full color contact monochrome mode while maintaining the contact state of the contact-separation mechanism 400. Now, a description will be provided of the full color contact monochrome mode.

Figure 8A:
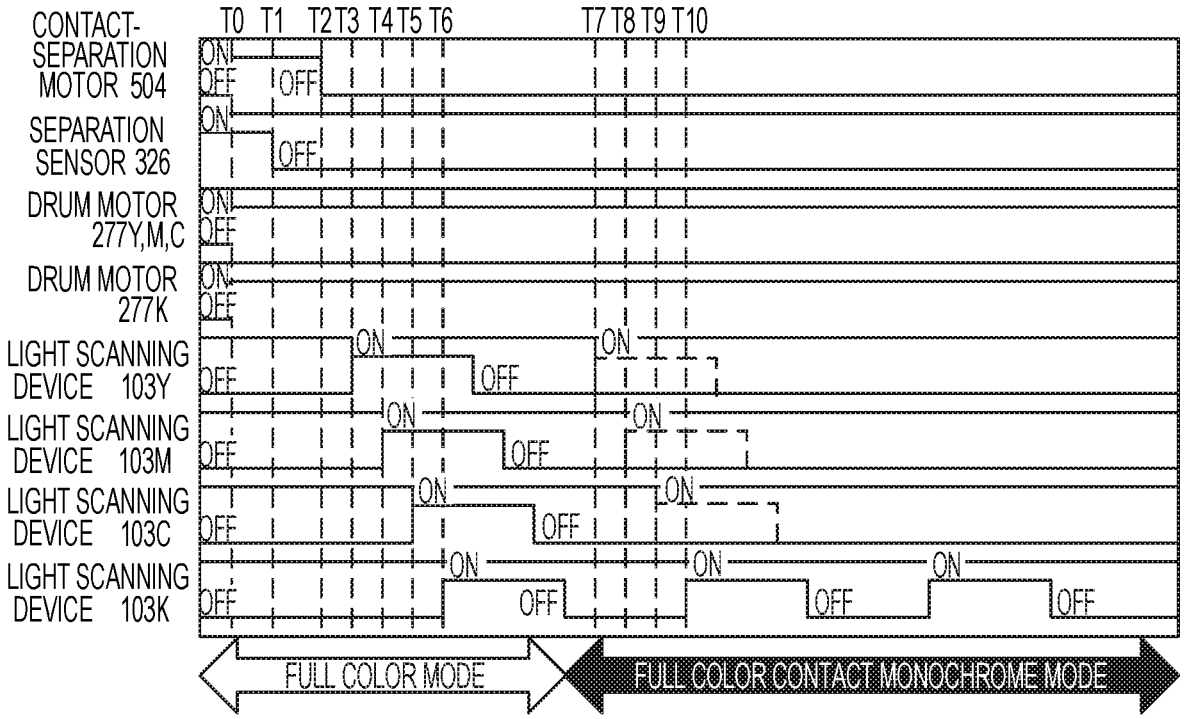
FIG. 8A and FIG. 8B are each a timing chart of an image forming operation in the first embodiment.
Figure 8B:
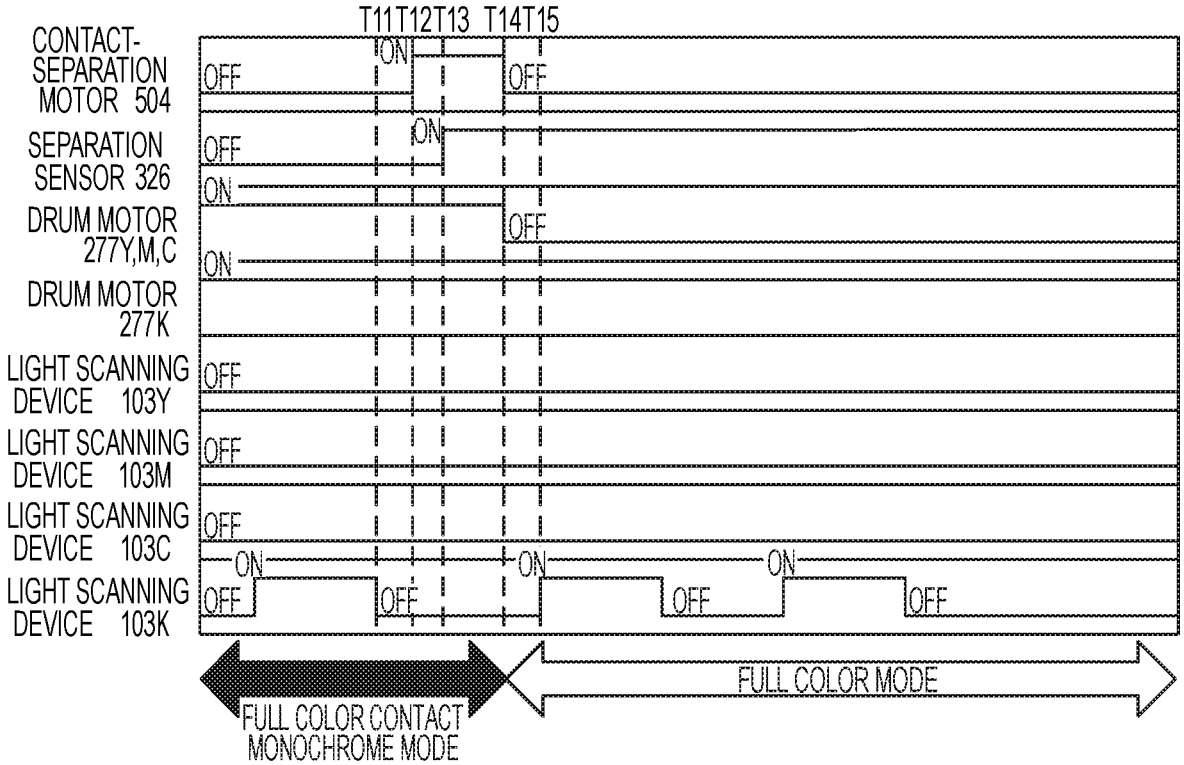

FIG. 8A and FIG. 8B are each a timing chart of the image forming operation in the first embodiment. In FIG. 8A and FIG. 8B, illustration is given of operations of the contact-separation motor 504, the separation sensor 326, the drum motors 277Y, 277M, 277C, and 277K, and the light scanning devices 103Y, 103M, 103C, and 103K. The drum motors 277Y, 277M, and 277C rotate the photosensitive drums 101Y, 101M, and 101C, respectively. The drum motor 277K rotates the photosensitive drum 101K.

FIG. 8A is a timing chart for illustrating a case in which a monochromatic image is formed successively after a full color image. At the time of starting the image forming operation, the CPU 301 instructs the image forming portion 271 to drive the contact-separation motor 504 and the drum motors 277Y, 277M, 277C, and 277K (T0). When the contact-separation detection flag 601 is separated from the separation sensor 326, and a detection signal given by the separation sensor 326 changes from an ON signal to an OFF signal (T1), the CPU 301 determines that the state of the contact-separation mechanism 400 is changed over from the separation state to the contact state. The CPU 301 stops the contact-separation motor 504 (T2). The CPU 301 sequentially turns on the light scanning devices 103Y, 103M, 103C, and 103K (T3, T4, T5, and T6) to form electrostatic latent images on the surfaces of the photosensitive drums 101Y, 101M, 101C, and 101K. After that, the CPU 301 sequentially turns off the light scanning devices 103Y, 103M, 103C, and 103K. In such a manner, a full color image is formed.

When a monochromatic image is to be formed successively after formation of a full color image, in the first embodiment, the state of the contact-separation mechanism 400 is not changed over from the contact state to the separation state. Then, at the timings T7, T8, and T9 at which the light scanning devices 103Y, 103M, and 103C are turned on in the case of forming the full color image, the light scanning devices 103Y, 103M, and 103C are not turned on. Only the light scanning device 103K (second light scanning device) is turned on (T10) while the light scanning devices 103Y, 103M, and 103C (first light scanning devices) are not turned on. With this, a monochromatic image is formed. Thus, the changeover operation for the states of the contact-separation mechanism 400 is not needed. Therefore, as compared to the case in which the state of the contact-separation mechanism 400 is changed over at each time of changing from the full color image formation to the monochromatic image formation, the frequency of the changeover operation which may cause the reduction in printing speed can be reduced. Such image forming mode is herein referred to as "full color contact monochrome mode".

In the full color contact monochrome mode, the photosensitive drums 101Y, 101M, and 101C which are not used for image formation are also driven. Therefore, there is a fear in that the lifetime of the photosensitive drums 101Y, 101M, and 101C is reduced due to contact with the intermediate transfer belt 130. Therefore, in the first embodiment, when monochromatic images are successively formed on three sheets in the full color contact monochrome mode, the mode is changed over to the monochrome mode. With this, successive formation of the monochromatic images for a long period of time in the full color contact monochrome mode is prevented, thereby preventing reduction in lifetime of the photosensitive drums 101Y, 101M, and 101C.

FIG. 8B is a timing chart for illustrating a case in which a monochromatic image is further formed successively after successive formation of monochromatic images on three sheets in the full color contact monochrome mode. When the light scanning device 103 is turned on for the third sheet in the full color contact monochrome mode (T11), and the toner image primarily transferred to the intermediate transfer belt 130 is secondarily transferred to the third sheet, the CPU 301 starts drive of the contact-separation motor 504 (T12). When the contact-separation detection flag 601 blocks light at the separation sensor 326, and the detection signal given by the separation sensor 326 is changed from the OFF signal to the ON signal (T13), the CPU 301 stops the drive of the contact-separation motor 504 and the drum motors 277Y, 277M, and 277C (T14). After that, the CPU 301 turns on the light scanning device 103K (T15) to form the monochromatic image. That is, in the case of further forming a monochromatic image successively after successive formation of monochromatic images on three sheets in the full color contact monochrome mode, the monochromatic image is formed in the monochrome mode in which only the light scanning device 103K is turned on in the separation state of the intermediate transfer belt 130.

(Image Forming Mode Determination Processing)

Figure 9:
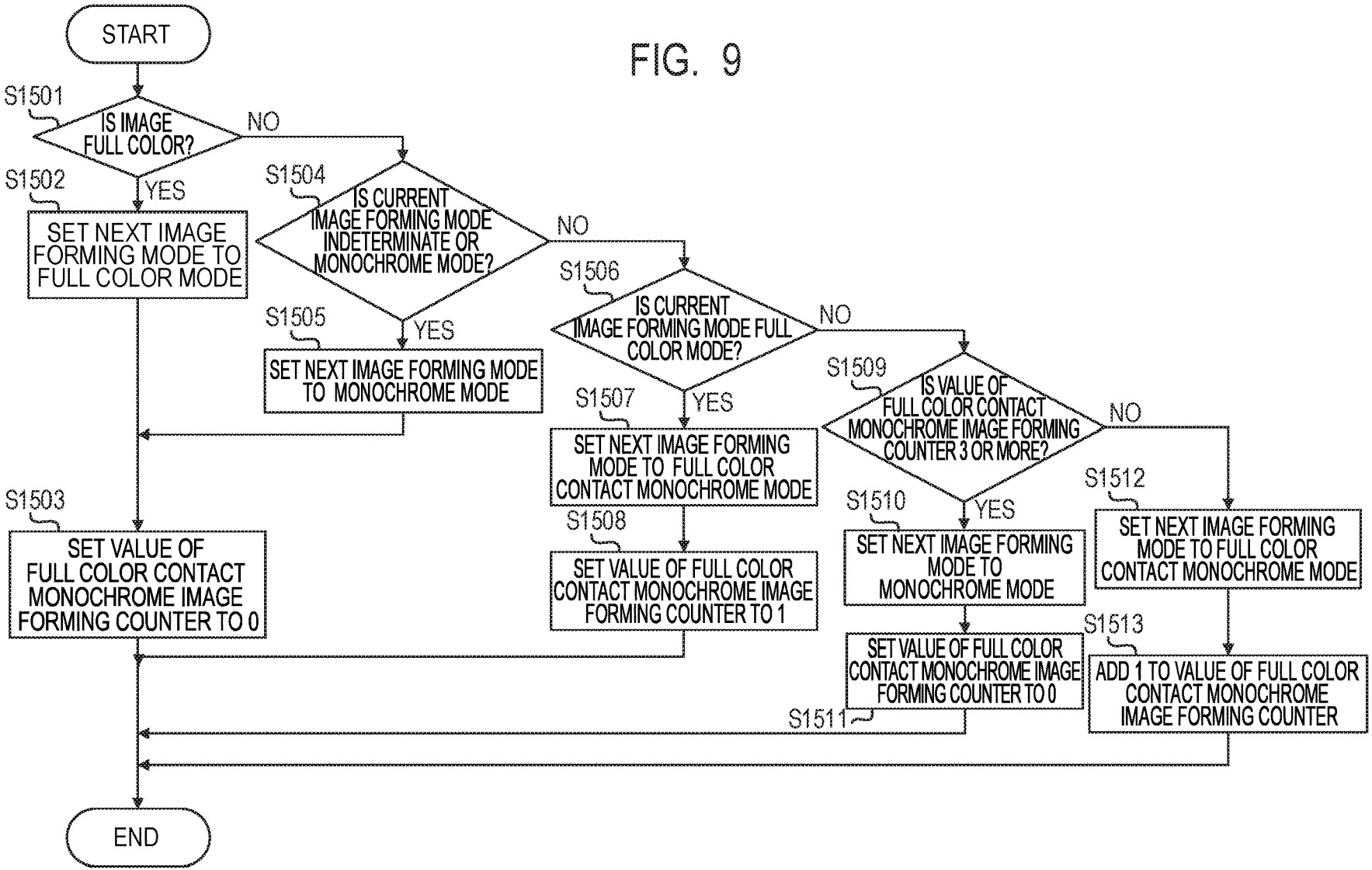
FIG. 9 is a flowchart for illustrating image forming mode determination processing in the first embodiment.

FIG. 9 is a flowchart for illustrating image forming mode determination processing in the first embodiment. The image forming mode determination processing illustrated in FIG. 9 is a sub routine to be executed in Step S1602 in FIG. 16 described later. The CPU 301 executes the image forming mode determination processing in accordance with a program stored in the ROM 302. The CPU 301 executes the image forming mode determination processing before forming an image for each page to determine the next image forming mode. In the first embodiment, when a print job is started, before the image forming mode determination processing is started, the CPU 301 initializes a current image forming mode to be indeterminate, and sets a value of a full color contact monochromatic image forming counter to 0. When the image forming mode determination processing is started, the CPU 301 determines whether or not an image to be formed is a full color image (Step S1501). When the image to be formed is a full color image (YES in Step S1501), the CPU 301 sets the next image forming mode stored in the RAM 303 to the full color mode (Step S1502). The CPU 301 sets a value of the full color contact monochromatic image forming counter stored in the RAM 303 to 0 (Step S1503).

When the image to be formed is not a full color image (NO in Step S1501), the CPU 301 determines whether or not the current image forming mode stored in the RAM 303 is indeterminate or the monochrome mode (Step S1504). When the current image forming mode is indeterminate or the monochrome mode (YES in Step S1504), the CPU 301 sets the next image forming mode stored in the RAM 303 to the monochrome mode (Step S1505). The CPU 301 sets the value of the full color contact monochromatic image forming counter stored in the RAM 303 to 0 (Step S1503).

Meanwhile, when the current image forming mode is not indeterminate or the monochrome mode (NO in Step S1504), the CPU 301 determines whether or not the current image forming mode is the full color mode (Step S1506). When the current image forming mode is the full color mode (YES in Step S1506), the image to be formed is a monochromatic image immediately after the full color image, and hence the next image forming mode is set to the full color contact monochrome mode. The CPU 301 sets the next image forming mode stored in the RAM 303 to the full color contact monochrome mode (Step S1507). The CPU 301 sets the value of the full color contact monochromatic image forming counter stored in the RAM 303 to 1 (Step S1508).

Meanwhile, when the current image forming mode is not the full color mode (NO in Step S1506), the current image forming mode is the full color contact monochrome image forming mode. In order to determine whether or not the number of sheets to be printed in the full color contact monochrome mode is 3 or more, the CPU 301 determines whether or not the value of the full color contact monochromatic image forming counter stored in the RAM 303 is 3 or more (Step S1509). When the value of the full color contact monochromatic image forming counter is 3 or more (YES in Step S1509), three monochromatic images are successively formed in the full color contact monochrome mode. The CPU 301 sets the next image forming mode stored in the RAM 303 to the monochrome mode (Step S1510). The CPU 301 sets the value of the full color contact monochromatic image forming counter stored in the RAM 303 to 0 (Step S1511).

Meanwhile, when the value of the full color contact monochromatic image forming counter is not 3 or more (NO in Step S1509), the CPU 301 sets the next image forming mode stored in the RAM 303 to the full color contact monochrome mode (Step S1512). The CPU 301 adds 1 to the value of the full color contact monochromatic image forming counter stored in the RAM 303 (Step S1513). Formation of the monochromatic image in the full color contact monochrome mode is continued.

According to the first embodiment, the image forming mode is determined by the image forming mode determination processing. Thus, as compared to the related art in which the state of the contact-separation mechanism 400 is changed over each time the image formation changes from the full color image formation to the monochromatic image formation, the frequency of the changeover operation can be reduced, thereby improving productivity. In the first embodiment, the number of monochromatic images to be successively formed in the full color contact monochrome mode is limited to three. Thus, as compared to the case in which the monochromatic images are successively formed in the full color contact monochrome mode without limitation to the number, the drive time of the photosensitive drums 101Y, 101M, and 101C which are not used for formation of a monochromatic image can be reduced. With this, the reduction in lifetime of the photosensitive drums 101Y, 101M, and 101C which are not used for formation of the monochromatic image can be prevented. In the first embodiment, an upper limit of the number of monochromatic images to be successively formed in the full color contact monochrome mode is set to three. However, the present invention is not limited to this number. For example, the upper limit of the number of monochromatic images to be successively formed may be set to, for example, 1, 2, 4, or 5.

(Transfer Cleaning Operation)

Figure 10A:
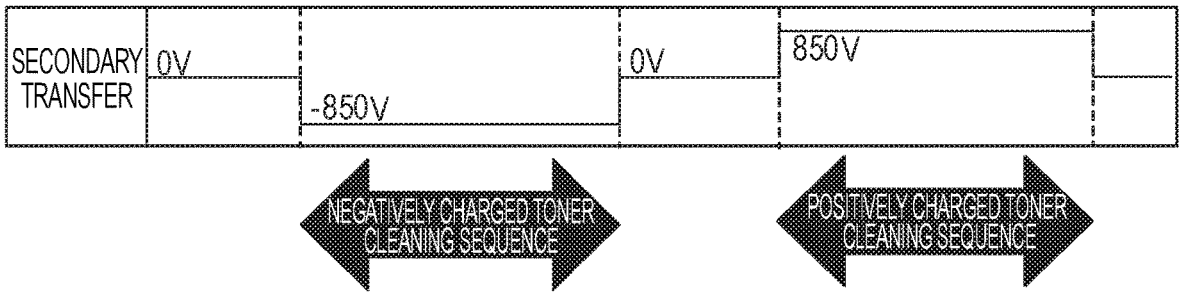
FIG. 10A, FIG. 10B, and FIG. 10C are each an explanatory view for illustrating a transfer cleaning operation in the first embodiment.
Figure 10B:
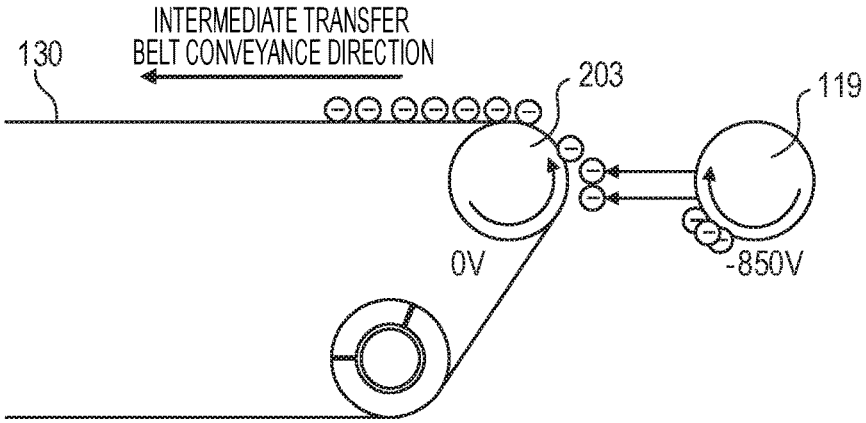
Figure 10C:
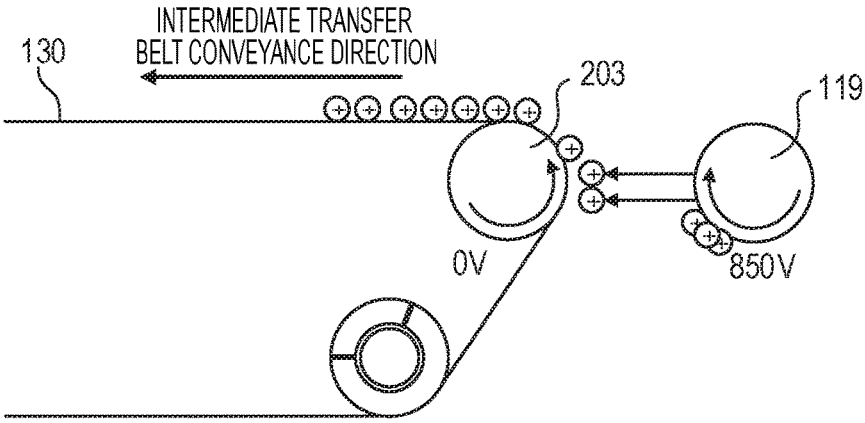

Next, a description will be provided of a transfer cleaning operation which is performed in an image forming retry operation described later. In the image forming retry operation, in order to remove dirt such as toner adhering to the secondary transfer outer roller 119, the image forming apparatus 100 performs the transfer cleaning operation. FIG. 10A, FIG. 10B, and FIG. 10C are each an explanatory view for illustrating the transfer cleaning operation in the first embodiment. FIG. 10A is an illustration of a high-voltage application sequence of applying a high voltage to the secondary transfer outer roller 119 when the transfer cleaning operation is performed. FIG. 10B is an illustration of an electric potential relationship between the secondary transfer inner roller 203 and the secondary transfer outer roller 119 during a negatively charged toner cleaning sequence. FIG. 10C is an illustration of an electric potential relationship between the secondary transfer inner roller 203 and the secondary transfer outer roller 119 during a positively charged toner cleaning sequence.

The toner used in the first embodiment is toner to be negatively charged. In order to remove the negatively charged toner adhering to the secondary transfer outer roller 119, the CPU 301 applies a voltage of −850 V to the secondary transfer outer roller 119 (negatively charged toner cleaning sequence in FIG. 10A). The secondary transfer inner roller 203 is connected to grounding, and has an electric potential of 0 V. At this time, as illustrated in FIG. 10B, the electric potential of the secondary transfer outer roller 119 is brought into a state of being lower than the electric potential of the secondary transfer inner roller 203 by 850 V. The negatively charged toner adhering to the secondary transfer outer roller 119 moves to the intermediate transfer belt 130 having a higher electric potential. When the CPU 301 rotates the intermediate transfer belt 130 in synchronization with the transfer cleaning operation, the negatively charged toner having been returned to the intermediate transfer belt 130 is collected by an intermediate transfer belt cleaner 142.

The toner used in the first embodiment is the toner to be negatively charged. However, some toner is abnormally charged to a positive electric potential. In order to move the toner having been abnormally charged to the positive electric potential from the secondary transfer outer roller 119 toward the intermediate transfer belt 130, the CPU 301 applies a voltage of 850 V to the secondary transfer outer roller 119 (positively charged toner cleaning sequence in FIG. 10A). At this time, as illustrated in FIG. 10C, the electric potential of the secondary transfer inner roller 203 is brought into the state of being lower than the electric potential of the secondary transfer outer roller 119 by 850 V. The positively charged toner adhering to the secondary transfer outer roller 119 moves toward the intermediate transfer belt 130 having a lower electric potential. When the CPU 301 rotates the intermediate transfer belt 130 in synchronization with the transfer cleaning operation, the toner having been abnormally charged to the positive electric potential and returned to the intermediate transfer belt 130 is also collected by the intermediate transfer belt cleaner 142. With this, the toner adhering to the secondary transfer outer roller 119 is removed, thereby preventing image abnormality such as dirt on a back surface of a sheet.

(Operation of Image Formation Precedence Type and Operation of Feed Precedence Type)

The image forming apparatus 100 is operable in an operation of an image formation precedence type in which the start of the image forming operation precedes the feeding operation and an operation of a feed precedence type in which the start of the feeding operation precedes the image forming operation. The image forming retry operation described later is changed depending on which one of the operation of the image formation precedence type and the operation of the feed precedence type is being performed by the image forming apparatus 100. Now, a description will be provided of the operation of the image formation precedence type and the operation of the feed precedence type.

Changeover between the operation of the image formation precedence type and the operation of the feed precedence type is determined based on the image forming mode and based on which one of the first feed cassette (feed cassette in the first stage) 111 and the second feed cassette (feed cassette in the second stage) 121 the sheet is fed from. FIG. 11A, FIG. 11B, and FIG. 11C are each an explanatory view for illustrating changeover between the image formation precedence type and the feed precedence type in the first embodiment. FIG. 11A is a table for showing a relationship between conveyance time for a toner image and conveyance time for a sheet. In FIG. 11A, there are shown image conveyance time from formation of an electrostatic latent image on the photosensitive drum 101K to arrival of a toner image at the secondary transfer portion 118 and image conveyance time from formation of an electrostatic latent image on the photosensitive drum 101Y to arrival of a toner image at the secondary transfer portion 118. Moreover, in FIG. 11A, there are shown sheet conveyance times from feeding of a sheet from each of the first feed cassette 111, the second feed cassette 121, and the manual feed tray 141 to arrival of the fed sheet at the secondary transfer portion 118. FIG. 11B is a sectional view for illustrating a main body 100A of the image forming apparatus 100, and is an explanatory view for illustrating an image forming condition of the operation of the feed precedence type. FIG. 11C is a sectional view for illustrating the main body 100A of the image forming apparatus 100, and is an explanatory view for illustrating an image forming condition of the operation of the image formation precedence type. Which one of the operation of the feed precedence type and the operation of the image formation precedence type is to be performed by the image forming apparatus 100 is determined based on the sheet conveyance time and the image conveyance time shown in the table of FIG. 11A. The image conveyance time is the time taken from formation of an electrostatic latent image on the photosensitive drum 101 provided most upstream at the time of image formation to arrival of a toner image at the secondary transfer portion 118.

FIG. 11B is an illustration of a relationship between an image conveyance distance D1 and a sheet conveyance distance D2 given when a sheet is fed from the first feed cassette 111 in the monochrome mode. The image forming operation in the monochrome mode is performed by using the photosensitive drum 101K for black toner, and hence the image conveyance distance D1 corresponds to a distance from an exposure position of the photosensitive drum 101K to the secondary transfer portion 118. An electrostatic latent image formed at the exposure position of the photosensitive drum 101K is developed with black toner. A black toner image is transferred to the intermediate transfer belt 130 and is conveyed to the secondary transfer portion 118. The image conveyance time from formation of the electrostatic latent image at the exposure position of the photosensitive drum 101K to arrival of the black toner image at the secondary transfer portion 118 is 0.6 seconds as shown in FIG. 11A. Meanwhile, the sheet conveyance time for conveyance of the sheet by the sheet conveyance distance D2 from the first feed cassette 111 to the secondary transfer portion 118 is 1 second as shown in FIG. 11A. That is, the sheet conveyance time for conveyance of the sheet by the sheet conveyance distance D2 from the first feed cassette 111 to the secondary transfer portion 118 is longer than the image conveyance time for conveyance of the image by the image conveyance distance D1 from the exposure position of the photosensitive drum 101K to the secondary transfer portion 118. In this case, it is required that the start of the feeding operation precede the image forming operation, and hence the operation of the feed precedence type is selected.

FIG. 11C is an illustration of a relationship between an image conveyance distance D3 and the sheet conveyance distance D2 given when a sheet is fed from the first feed cassette 111 in the full color mode. The image forming operation in the full color mode is performed by using the photosensitive drums 101Y, 101M, 101C, and 101K, and hence the image conveyance distance D3 corresponds to a distance from an exposure position of the photosensitive drum 101Y for yellow toner provided most upstream to the secondary transfer portion 118. The image conveyance time from formation of the electrostatic latent image at the exposure position of the photosensitive drum 101Y to arrival of the yellow toner image at the secondary transfer portion 118 is 1.85 seconds as shown in FIG. 11A. Meanwhile, the sheet conveyance time for conveyance of the sheet by the sheet conveyance distance D2 from the first feed cassette 111 to the secondary transfer portion 118 is 1 second as shown in FIG. 11A. That is, the sheet conveyance time for conveyance of the sheet by the sheet conveyance distance D2 from the first feed cassette 111 to the secondary transfer portion 118 is shorter than the image conveyance time for conveyance of the image by the image conveyance distance D3 from the exposure position of the photosensitive drum 101Y to the secondary transfer portion 118. In this case, it is required that the start of the image forming operation precede the feeding operation, and hence the operation of the image formation precedence type is selected.

As described above, when the image conveyance time is longer than the sheet conveyance time, the operation of the image formation precedence type is selected. When the sheet conveyance time is longer than the image conveyance time, the operation of the feed precedence type is selected. In the full color contact monochrome mode, as described above with reference to FIG. 8A, the light scanning devices 103Y, 103M, and 103C are not turned on but only the light scanning device 103K for black toner is turned on at the image forming timing of the full color mode, to thereby form an image. Therefore, the image conveyance time in the full color contact monochrome mode is 1.85 seconds, which is equal to the image conveyance time in the full color mode. Thus, the changeover condition for the operation of the image formation precedence type and the operation of the feed precedence type is the same as that for the full color mode and the full color contact monochrome mode.

FIG. 12 is a search table for showing changeover conditions for the image formation precedence type and the feed precedence type in the first embodiment. The search table shown in FIG. 12 is stored in the ROM 302. The CPU 301 refers to the search table stored in the ROM 302 at the time of image formation to determine which one of the operation of the image formation precedence type and the operation of the feed precedence type is to be performed.

(Image Forming Retry Operation)

In the related art, when the conveyance of the sheet to the secondary transfer portion 118 does not match a transfer timing of the image due to the sheet conveyance delay caused by slipping of the feed roller 114, a jam is displayed, and the image forming operation is stopped. However, the sheet conveyance delay caused by the slipping of the feed roller 114 is eliminated by performing the feeding operation again in many cases, except for a case in which the feed roller 114 is in the end of lifetime. Therefore, in order to prevent a jam processing operation by a user due to the sheet conveyance delay caused by slipping of the feed roller 114, in the first embodiment, the image forming retry operation is performed. Now, with reference to FIG. 13A, FIG. 13B, FIG. 13C, and FIG. 13D, a description will be provided of the image forming retry operation in the first embodiment. FIG. 13A, FIG. 13B, FIG. 13C, and FIG. 13D are timing charts for illustrating normal image forming operations and image forming retry operations. FIG. 13A, FIG. 13B, FIG. 13C, and FIG. 13D are each illustrations of operation timings of the conveyance motor 276, a feed sensor 109, the light scanning device 103, and the secondary transfer portion 118.

Figure 13A:
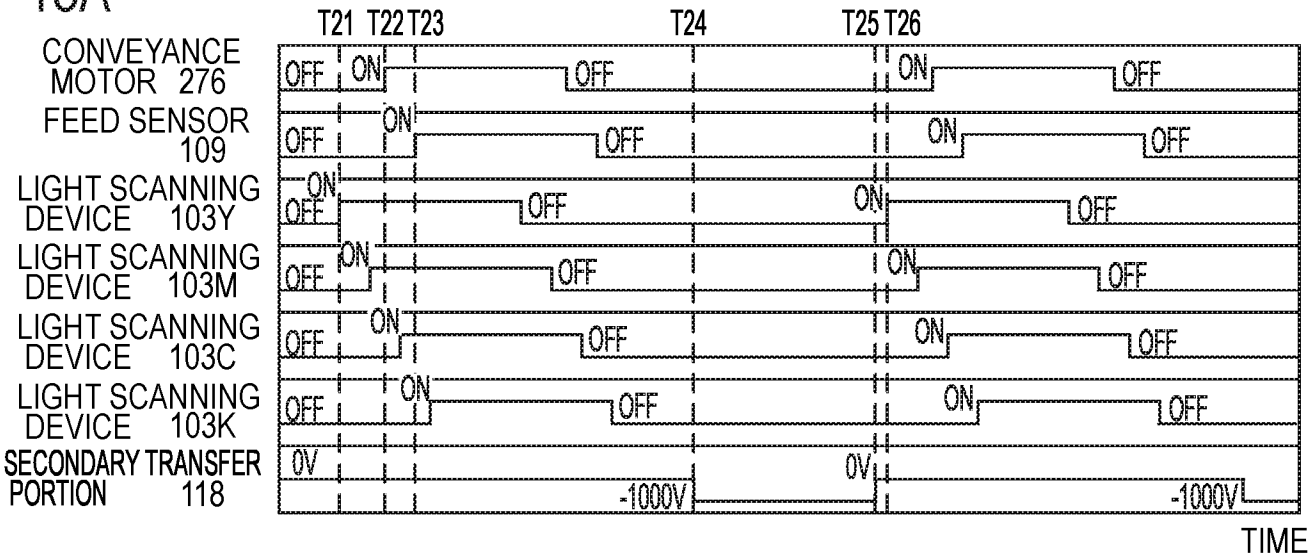
FIG. 13A, FIG. 13B, FIG. 13C, and FIG. 13D are timing charts for illustrating normal image forming operations and image forming retry operations.

FIG. 13A is a timing chart for illustrating the normal image forming operation of the image formation precedence type. The CPU 301 outputs an image formation start instruction to the image forming portion 271. When the image formation start instruction is received, the image forming portion 271 applies a predetermined voltage to each of the charging roller 102, the primary transfer roller 105, and the developing device 104 and turns on the light scanning device 103 (T21). After that, the CPU 301 outputs a feeding operation start instruction to the recording medium conveying portion 270 so that the toner image and the sheet arrive at the secondary transfer portion 118 at the same timing. When the feeding operation start instruction is received, the recording medium conveying portion 270 drives the feed roller 114 by the conveyance motor 276 to start conveyance of the sheet (T22). At this time, the CPU 301 monitors, by using the feed sensor 109 being a detector, whether or not the sheet is normally conveyed. When the feed sensor 109 is turned on within a predetermined time period (T23), the CPU 301 continues conveyance of the sheet. After that, in accordance with a timing at which the sheet arrives at the secondary transfer portion 118 by the recording medium conveying portion 270, the CPU 301 applies a secondary high voltage to the secondary transfer outer roller 119 (T24) and transfers the toner image on the intermediate transfer belt 130 to the sheet. The secondary transfer operation is performed until a trailing edge of the sheet passes the secondary transfer portion 118 (T25). When the secondary transfer operation is completed up to the trailing edge of the sheet, the CPU 301 starts the image forming operation for the next sheet and turns on the light scanning device 103 (T26). As described above, after the image forming operation for the preceding sheet is completed, the image forming operation for the next sheet is started.

Figure 13B:
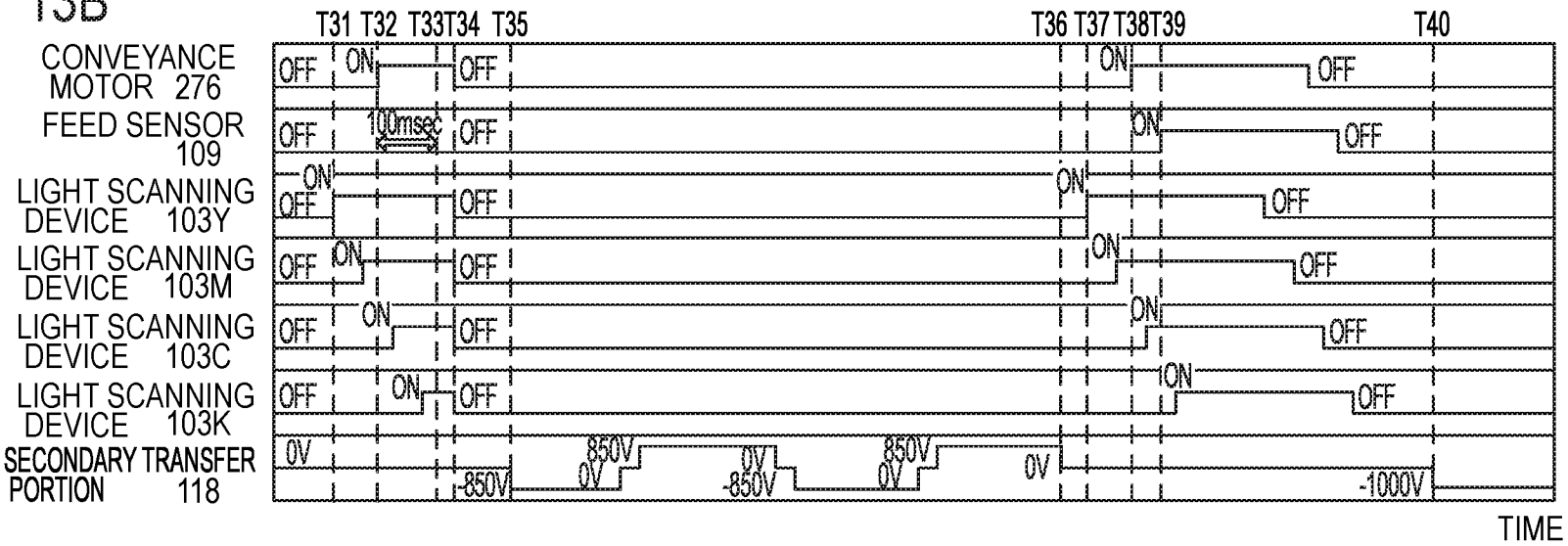

FIG. 13B is a timing chart for illustrating the image forming retry operation in the image forming operation of the image formation precedence type. When the sheet conveyance delay caused by slipping of the feed roller 114 occurs, the image forming retry operation is performed. The CPU 301 turns on the light scanning device 103 (T31), and thereafter starts feeding of the sheet by the conveyance motor 276 (T32). However, when the feed sensor 109 is not turned on even after elapse of a predetermined time period (for example, 10 msec) from the start of the drive of the conveyance motor 276, the CPU 301 determines that the sheet conveyance delay has occurred (T33). When the sheet conveyance delay occurs (T33), the CPU 301 instructs the recording medium conveying portion 270 to interrupt the conveyance operation for the sheet, instructs the image forming portion 271 to interrupt the image forming operation for an image being currently formed, and turns off laser light from the light scanning device 103 (T34).

At this time, a yellow toner image, a magenta toner image, a cyan toner image, and a black toner image are formed on the intermediate transfer belt 130. Therefore, when those toner images pass the secondary transfer portion 118, toner adheres to the secondary transfer outer roller 119. In order to prevent adhesion of dirt on the back of the sheet by toner adhering to the secondary transfer outer roller 119, the CPU 301 starts the above-mentioned transfer cleaning operation (T35) to perform cleaning of the secondary transfer outer roller 119. When the transfer cleaning operation is completed (T36), the CPU 301 re-forms the image supposed to be formed at T31 (T37), and starts drive of the feed roller 114 by the conveyance motor 276 (T38) to feed the sheet. When the feed sensor 109 is turned on within the predetermined time period (T39), the CPU 301 continues conveyance of the sheet. After that, at the timing at which the sheet is conveyed by the recording medium conveying portion 270 to the secondary transfer portion 118, the CPU 301 applies a secondary high voltage to the secondary transfer outer roller 119 (T40), and transfers the toner image on the intermediate transfer belt 130 to the sheet. The secondary transfer operation is performed until the trailing edge of the sheet passes the secondary transfer portion 118.

As described above, when the image forming operation is stopped due to the sheet conveyance delay caused by slipping of the feed roller 114 in the image forming operation of the image formation precedence type, the transfer cleaning operation, restart of the image forming operation, and restart of the sheet conveyance are performed by the image forming retry operation. When the feed sensor 109 is not turned on even after elapse of the predetermined time period (for example, 100 msec) from the start of the drive of the conveyance motor 276 by the image forming retry operation (T38), the CPU 301 displays occurrence of a jam. Simultaneously with the display of the occurrence of the jam, the CPU 301 suspends the image formation and the sheet conveyance and completes the image forming operation of the image formation precedence type.

Figure 13C:
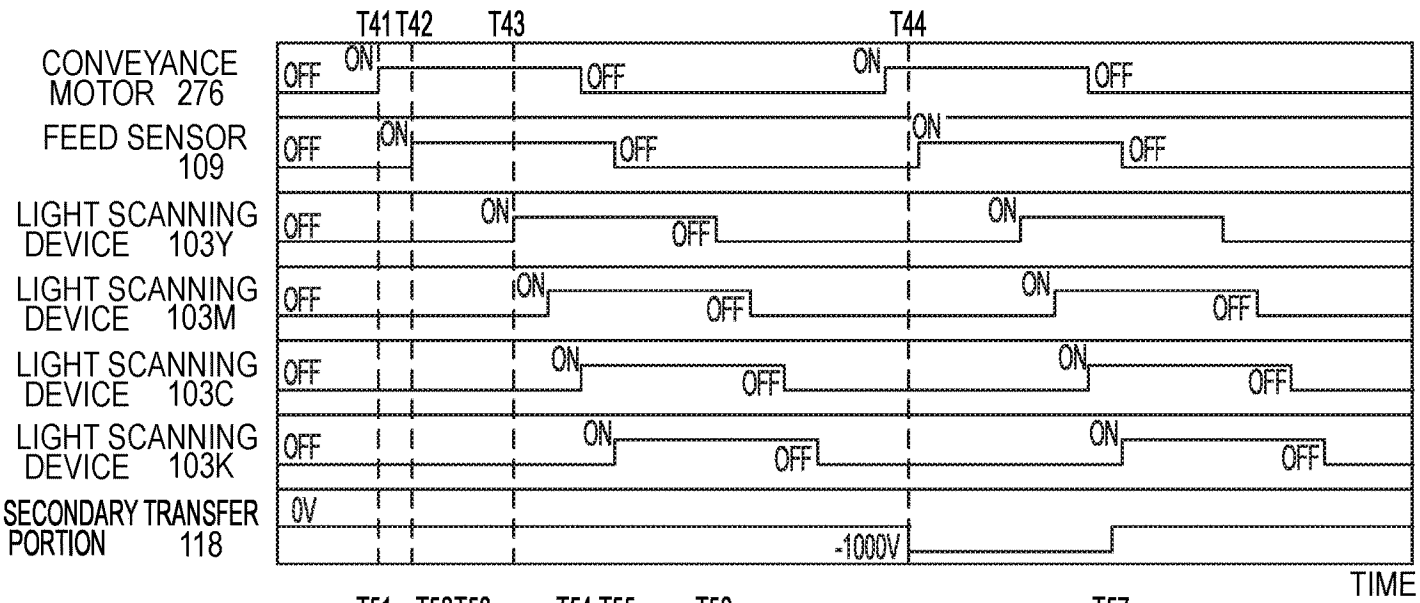

FIG. 13C is a timing chart for illustrating a normal image forming operation of the feed precedence type. In the case of the image forming operation of the feed precedence type, the start of the drive of the conveyance motor 276 by the recording medium conveying portion 270 (T41) precedes the operation of turning on the light scanning device 103 by the image forming portion 271 (T43). The CPU 301 monitors, by using the feed sensor 109, whether or not the sheet is normally conveyed. When the feed sensor 109 is turned on within a predetermined time period (T42), the CPU 301 continues conveyance of the sheet. After that, the operation of turning on the light scanning device 103 is started (T43) so that the toner image arrives at the secondary transfer portion 118 at the timing at which the sheet arrives at the secondary transfer portion 118, and the image is formed. The CPU 301 applies the secondary high voltage to the secondary transfer outer roller 119 in accordance with the timing at which the sheet arrives at the secondary transfer portion 118 (T44), and the toner image on the intermediate transfer belt 130 is transferred to the sheet.

Figure 13D:
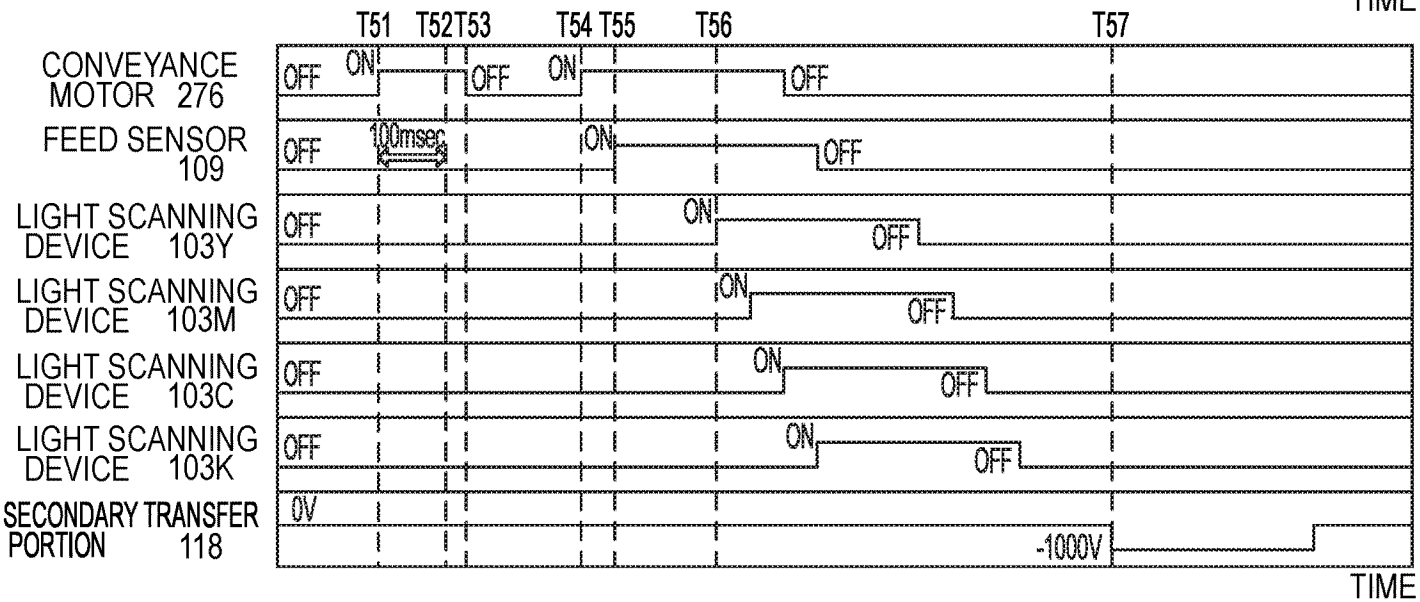

FIG. 13D is a timing chart for illustrating the image forming retry operation in the image forming operation of the feed precedence type. When the sheet conveyance delay caused by the slipping of the feed roller 114 occurs, the image forming retry operation is performed. When the drive of the conveyance motor 276 by the recording medium conveying portion 270 is started (T51), the CPU 301 monitors, by using the feed sensor 109, whether or not the sheet is normally conveyed. However, when the feed sensor 109 is not turned on even after elapse of a predetermined time period (for example, 100 msec) from the start of the drive of the conveyance motor 276, the CPU 301 determines that the sheet conveyance delay has occurred (T52). When the sheet conveyance delay occurs (T52), the CPU 301 instructs the recording medium conveying portion 270 to interrupt the conveyance operation for the sheet, and stops the conveyance motor 276 (T53). At this time, the light scanning devices 103Y, 103M, 103C, and 103K are not still turned on, and hence the image formation is not performed. The transfer cleaning operation for the secondary transfer portion 118 is not needed because the image formation is not performed. The CPU 301 starts the drive of the conveyance motor 276 again (T54) to convey the sheet. When the feed sensor 109 is turned on within the predetermined time period (T55), the CPU 301 continues the conveyance of the sheet. After that, the CPU 301 controls the image forming portion 271 to turn on the light scanning device 103 and start the image forming operation (T56). After that, in accordance with the timing at which the sheet arrives at the secondary transfer portion 118 by the recording medium conveying portion 270, the CPU 301 applies the secondary high voltage to the secondary transfer outer roller 119 (T57) to transfer the toner image on the intermediate transfer belt 130 to the sheet.

As described above, when the sheet conveyance operation is stopped due to the sheet conveyance delay caused by the slipping of the feed roller 114 in the image forming operation of the feed precedence type, the sheet conveyance operation is restarted by the image forming retry operation. In the first embodiment, the sheet conveyance delay is detected by using the feed sensor 109. However, the sheet conveyance delay may be detected by using another sheet sensor provided upstream of the secondary transfer portion 118.

(Image Forming Retry Operation in Full Color Contact Monochrome Mode)

Figure 14A:
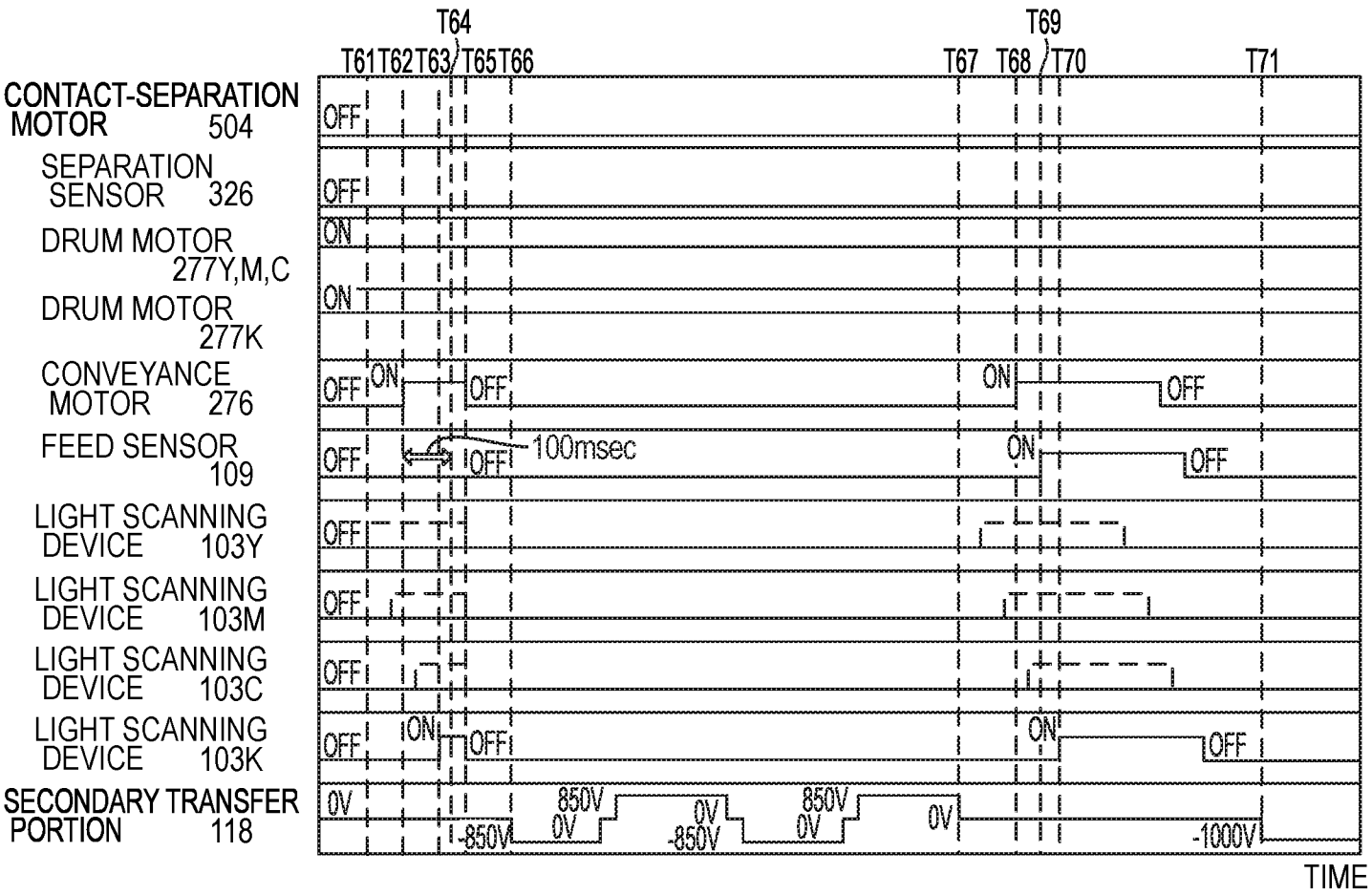
FIG. 14A and FIG. 14B are each a timing chart for illustrating an image forming retry operation in the full color contact monochrome mode.
Figure 14B:
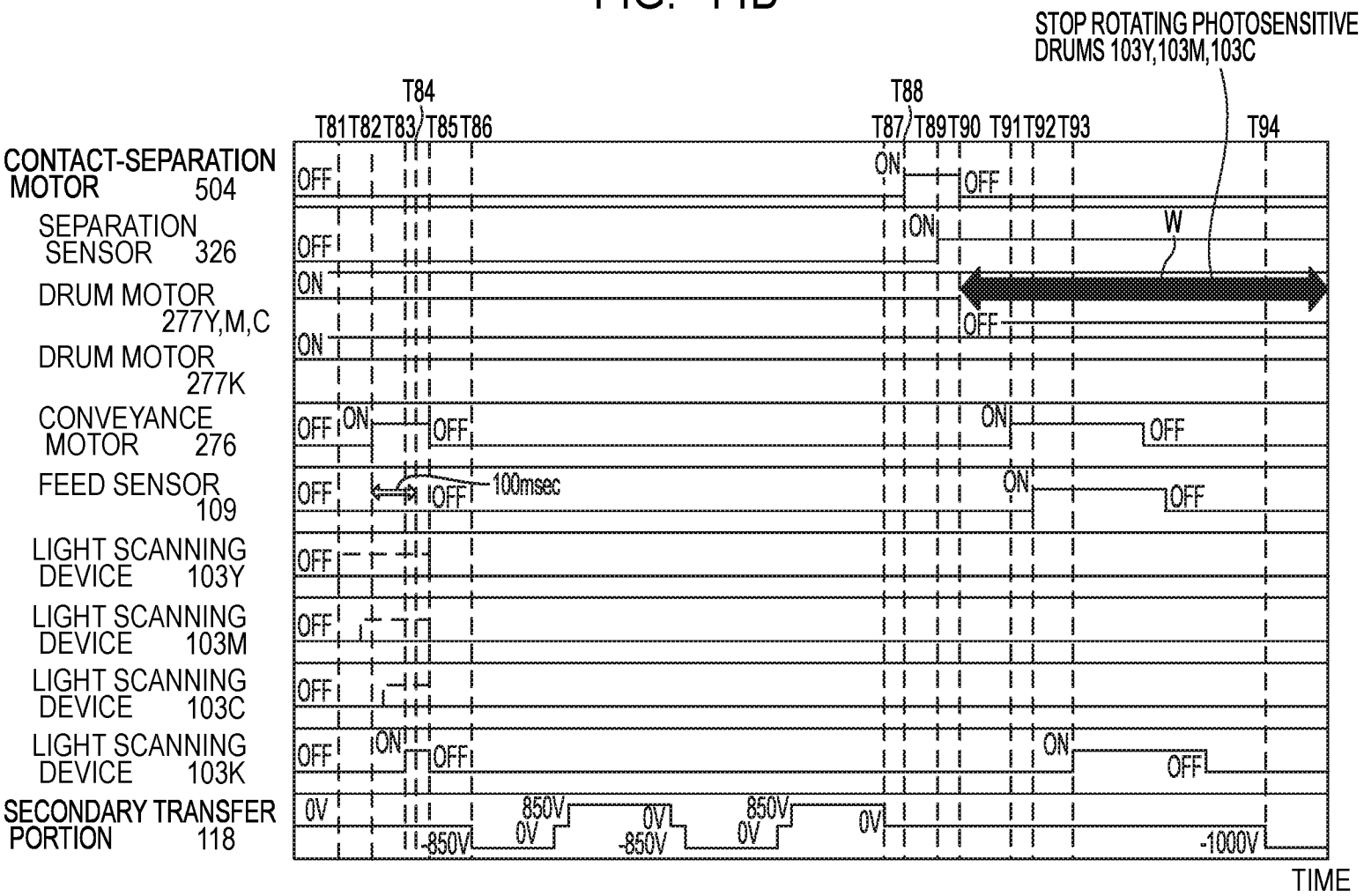

FIG. 14A and FIG. 14B are each a timing chart for illustrating the image forming retry operation in the full color contact monochrome mode. FIG. 14A and FIG. 14B are each illustrations of operation timings of the contact-separation motor 504, the separation sensor 326, the drum motors 277Y, 277M, 277C, and 277K, the conveyance motor 276, the feed sensor 109, the light scanning devices 103Y, 103M, 103C, and 103K, and the secondary transfer portion 118. In the full color contact monochrome mode, when an image is to be formed on a sheet conveyed from the first feed cassette 111, as shown in the search table in FIG. 12, an image is formed by the operation of the image formation precedence type. When the sheet conveyance delay caused by the slipping of the feed roller 114 occurs, the image forming retry operation is performed.

FIG. 14A is a timing chart for illustrating an image forming retry operation in a full color contact monochrome mode in the related art. In the full color contact monochrome mode, the image is formed by the operation of the image formation precedence type, and hence the photosensitive drums 101Y, 101M, and 101C are also driven. However, the light scanning device 103Y is not turned on at a turn-on timing (T61) of the light scanning device 103Y with respect the photosensitive drum 101Y which is not used for the image formation. Similarly, the light scanning devices 103M and 103C are also not turned on. The CPU 301 drives the feed roller 114 by the conveyance motor 276 (T62) to start conveyance of the sheet. At this time, the CPU 301 monitors, by using the feed sensor 109, whether or not the sheet is normally conveyed. The CPU 301 turns on only the light scanning device 103K (T63) to start formation of the monochromatic image. However, when the feed sensor 109 is not turned on even after elapse of a predetermined time period (for example, 100 msec) from the start of the drive of the conveyance motor 276, the CPU 301 determines that the sheet conveyance delay has occurred (T64). When the sheet conveyance delay occurs (T64), the CPU 301 instructs the recording medium conveying portion 270 to interrupt the conveyance operation for the sheet, instructs the image forming portion 271 to interrupt the image forming operation for an image being currently formed, and turns off the laser light from the light scanning device 103K (T65).

At this time, a black toner image is formed on the intermediate transfer belt 130. Therefore, when the black toner image passes the secondary transfer portion 118, toner adheres to the secondary transfer outer roller 119. In order to prevent dirt on the back of the sheet by toner adhering to the secondary transfer outer roller 119, the CPU 301 starts the above-mentioned transfer cleaning operation (T66) to perform cleaning of the secondary transfer outer roller 119. When the transfer cleaning operation is completed (T67), the CPU 301 drives the feed roller 114 by the conveyance motor 276 (T68) to restart the conveyance of the sheet. When the feed sensor 109 is turned on within the predetermined time period (T69), the CPU 301 continues conveyance of the sheet. In order to re-form the image supposed to be formed at T63, the CPU 301 turns on only the light scanning device 103K (T70) to start formation of the monochromatic image. After that, at the timing at which the sheet is conveyed to the secondary transfer portion 118 by the recording medium conveying portion 270, the CPU 301 applies the secondary high voltage to the secondary transfer outer roller 119 (T71) to transfer the toner image on the intermediate transfer belt 130 to the sheet.

In the image forming retry operation in the full color contact monochrome mode in the related art, even after completion of the transfer cleaning operation for the secondary transfer portion 118 (T67), the contact state of the intermediate transfer unit 140 is maintained without causing the contact-separation motor 504 to operate. Therefore, also during the image forming retry operation, the photosensitive drums 101Y, 101M, and 101C are rotated in a state of being held in contact with the intermediate transfer belt 130. Thus, in the related art, the surfaces of the photosensitive drums 101Y, 101M, and 101C are worn by contact with the surface of the intermediate transfer belt 130, with the result that the lifetime of the photosensitive drums 101Y, 101M, and 101C may be shortened.

Next, with reference to FIG. 14B, a description will be provided of the image forming retry operation in the full color contact monochrome mode in the first embodiment. FIG. 14B is a timing chart for illustrating the image forming retry operation in the full color contact monochrome mode in the first embodiment. At the turn-on timing (T81) of the light scanning device 103Y, the light scanning device 103Y is not turned on, and conveyance of a sheet is started by the conveyance motor 276 (T82). After that, only the light scanning device 103K is turned on (T83), and formation of the monochromatic image is started. However, the sheet conveyance delay occurs (T84), and the CPU 301 interrupts the sheet conveyance and the image forming operation (T85). The CPU 301 starts the transfer cleaning operation (T86). After the transfer cleaning operation is completed (T87), the CPU 301 drives the contact-separation motor 504 (T88) to change over the state of the intermediate transfer unit 140 from the contact state to the separation state. When an ON signal of the separation sensor 326 is detected (T89), the CPU 301 determines that the intermediate transfer unit 140 is in the separation state. Then, the CPU 301 stops the contact-separation motor 504, and stops the drum motors 277Y, 277M, and 277C (T90). The CPU 301 drives the feed roller 114 by the conveyance motor 276 (T91), and restarts conveyance of the sheet. When the feed sensor 109 is turned on within the predetermined time period (T92), the CPU 301 continues the conveyance of the sheet. In order to re-form the image supposed to be formed at T83, the CPU 301 turns on only the light scanning device 103K (T93) to start formation of the monochromatic image. After that, at the timing at which the sheet is conveyed by the recording medium conveying portion 270 to the secondary transfer portion 118, the CPU 301 applies the secondary high voltage to the secondary transfer outer roller 119 (T94) to transfer the toner image on the intermediate transfer belt 130 to the sheet.

As described above, according to the first embodiment, after the transfer cleaning operation is performed in the image forming retry operation due the sheet conveyance delay, the state of the intermediate transfer unit 140 is changed over from the contact state to the separation state (T88). When the changeover of the intermediate transfer unit 140 to the separation state is completed (T89), the drive of the drum motors 277Y, 277M, and 277C is stopped (T90), and the image forming mode is changed over to the monochrome mode to perform the image forming operation. Thus, as compared to the image forming retry operation in the related art, the influence of the image forming operation on the lifetime of the photosensitive drums 101Y, 101M, and 101C can be reduced by the interval W in FIG. 14B.

There is a case in which, after the image forming mode is changed over to the monochrome mode by the image forming retry operation as illustrated in FIG. 14B and the monochromatic image is formed, the next page is a full color image. In such case, the mode is changed over from the full color contact monochrome mode to the monochrome mode and further changed over from the monochrome mode to the full color mode, that is, the changeover operation for the image forming mode frequently occurs. When the frequency of the changeover operation for the image forming mode increases, the printing speed is significantly reduced. In order to solve this problem, when it is known in advance that the next page subsequent to the image forming retry operation is a full color image, it is not required to change over the image forming mode from the full color contact monochrome mode to the monochrome mode.

Figure 15A:
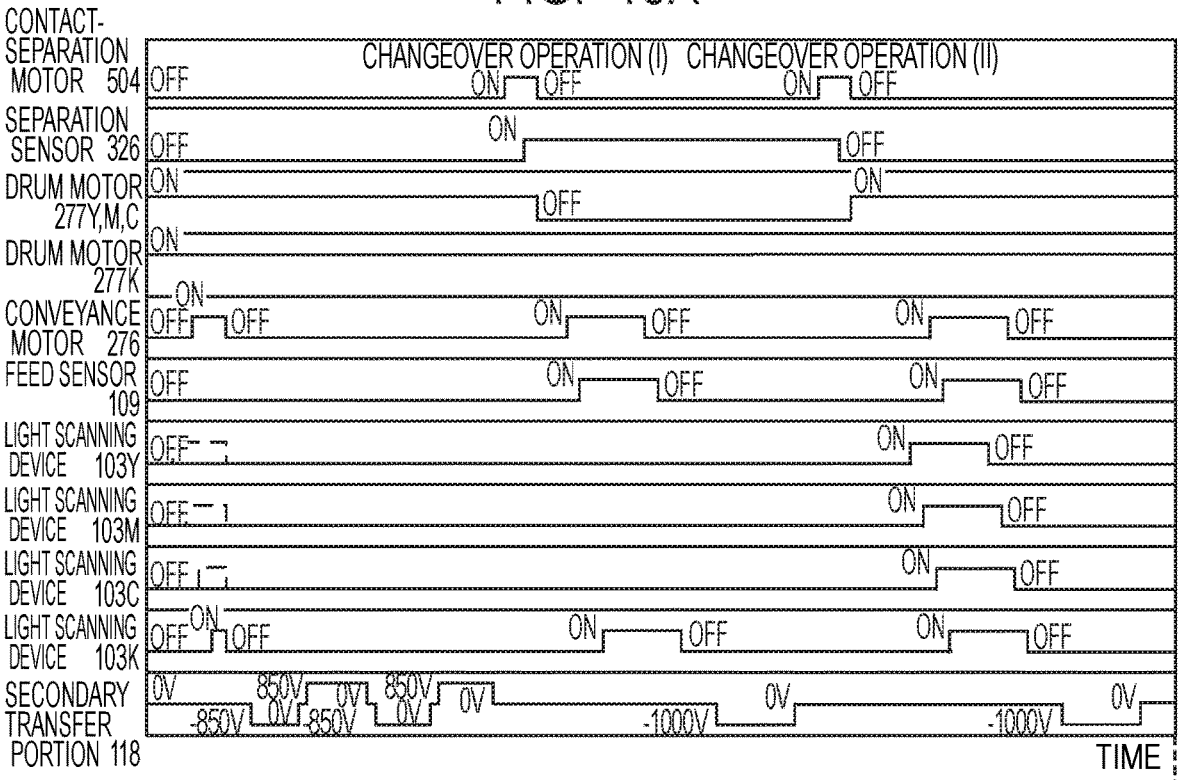
FIG. 15A is a timing chart for illustrating a case in which a state of the intermediate transfer unit is changed over in the image forming retry operation in the first embodiment.
Figure 15B:
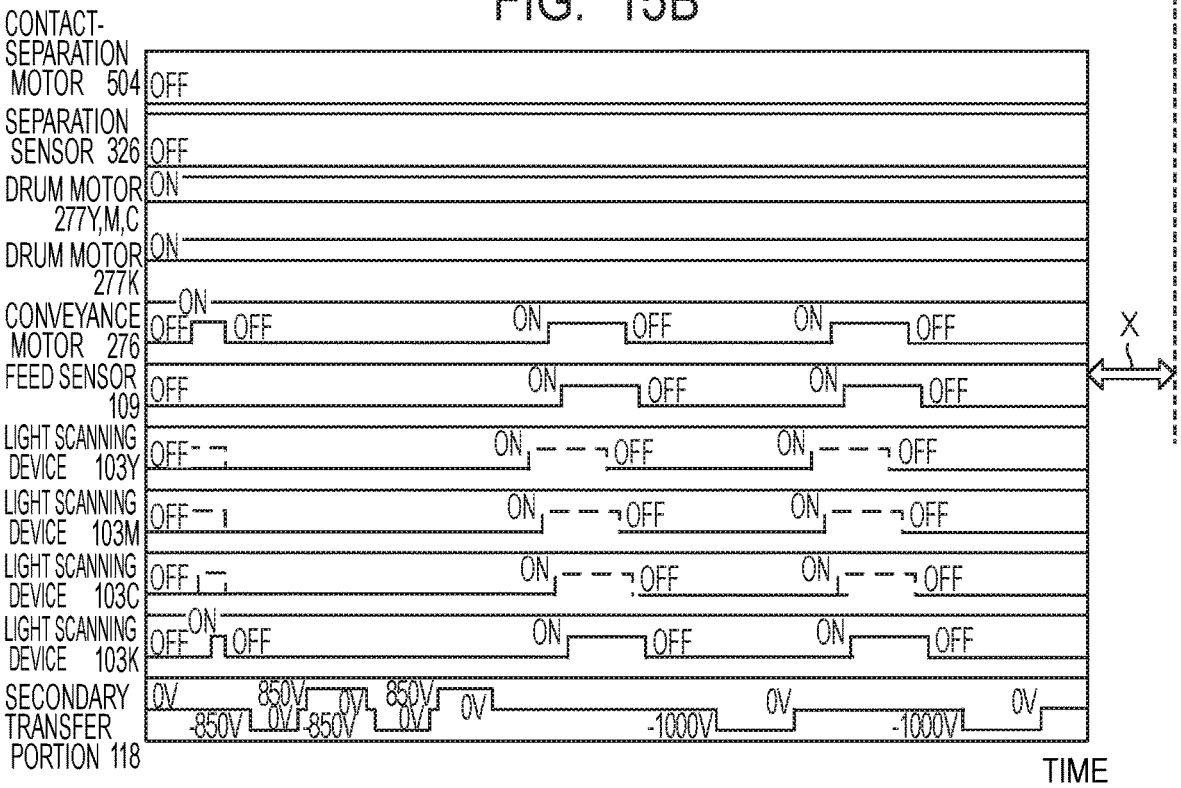
FIG. 15B is a timing chart for illustrating a case in which the state of the intermediate transfer unit is not changed over in the image forming retry operation in the first embodiment.

Now, with reference to FIG. 15A and FIG. 15B, a description will be provided of an example in which the image forming mode is not changed over when the next page subsequent to the monochromatic image formed by the image forming retry operation is a full color image. FIG. 15A is a timing chart for illustrating a case in which the state of the intermediate transfer unit 140 is changed over in the image forming retry operation in the first embodiment, and FIG. 15B is a timing chart for illustrating a case in which the state of the intermediate transfer unit 140 is not changed over in the image forming retry operation in the first embodiment. When the next page subsequent to the monochromatic image formed by the image forming retry operation in the full color contact monochrome mode is a full color image, the state of the intermediate transfer unit 140 is maintained in the contact state without changeover of the state to the separation state, thereby reducing the printing time.

FIG. 15A is a timing chart for illustrating an operation of changing over the state of the intermediate transfer unit 140 to the separation state when the next page subsequent to the monochromatic image formed by the image forming retry operation in the full color contact monochrome mode is a full color image. In the image forming retry operation, the state of the intermediate transfer unit 140 is changed over from the contact state to the separation state by a changeover operation (I) illustrated in FIG. 15A. In the case in which the next page subsequent to the monochromatic image formed by the image forming retry operation is a full color image, when the intermediate transfer unit 140 is in the separation state, images of yellow, magenta, and cyan cannot be formed. Therefore, it is required that the state of the intermediate transfer unit 140 be changed over from the separation state to the contact state again by the changeover operation (II) illustrated in FIG. 15A. That is, in the image forming operation illustrated in FIG. 15A, it is required that the changeover operation for the state of the intermediate transfer unit 140 be performed twice.

FIG. 15B is a timing chart for illustrating an operation of maintaining the state of the intermediate transfer unit 140 in the contact state without changeover of the state to the separation state when the next page subsequent to the monochromatic image formed by the image forming retry operation in the full color contact monochrome mode is a full color image. In this case, the monochromatic image formed by the image forming retry operation is formed in the full color contact monochrome mode. In the full color contact monochrome mode, the intermediate transfer unit 140 is in the contact state. Therefore, when a full color image is to be formed as the next page subsequent to the monochromatic image formed by the image forming retry operation, it is not required to change over the state of the intermediate transfer unit 140. Therefore, in the case illustrated in FIG. 15B in which the state of the intermediate transfer unit 140 is not changed over, the output time of a print material can be shortened by the interval X as compared to the case illustrated in FIG. 15A in which the state of the intermediate transfer unit 140 is changed over. In the first embodiment, the state of the intermediate transfer unit 140 is changed over in accordance with whether or not the next page is a full color image. However, the state of the intermediate transfer unit 140 may be changed over in accordance with whether or not an image after a plurality of pages of images by the image forming retry operation is a full color image.

(Image Forming Operation)

Figures 16, 16A:
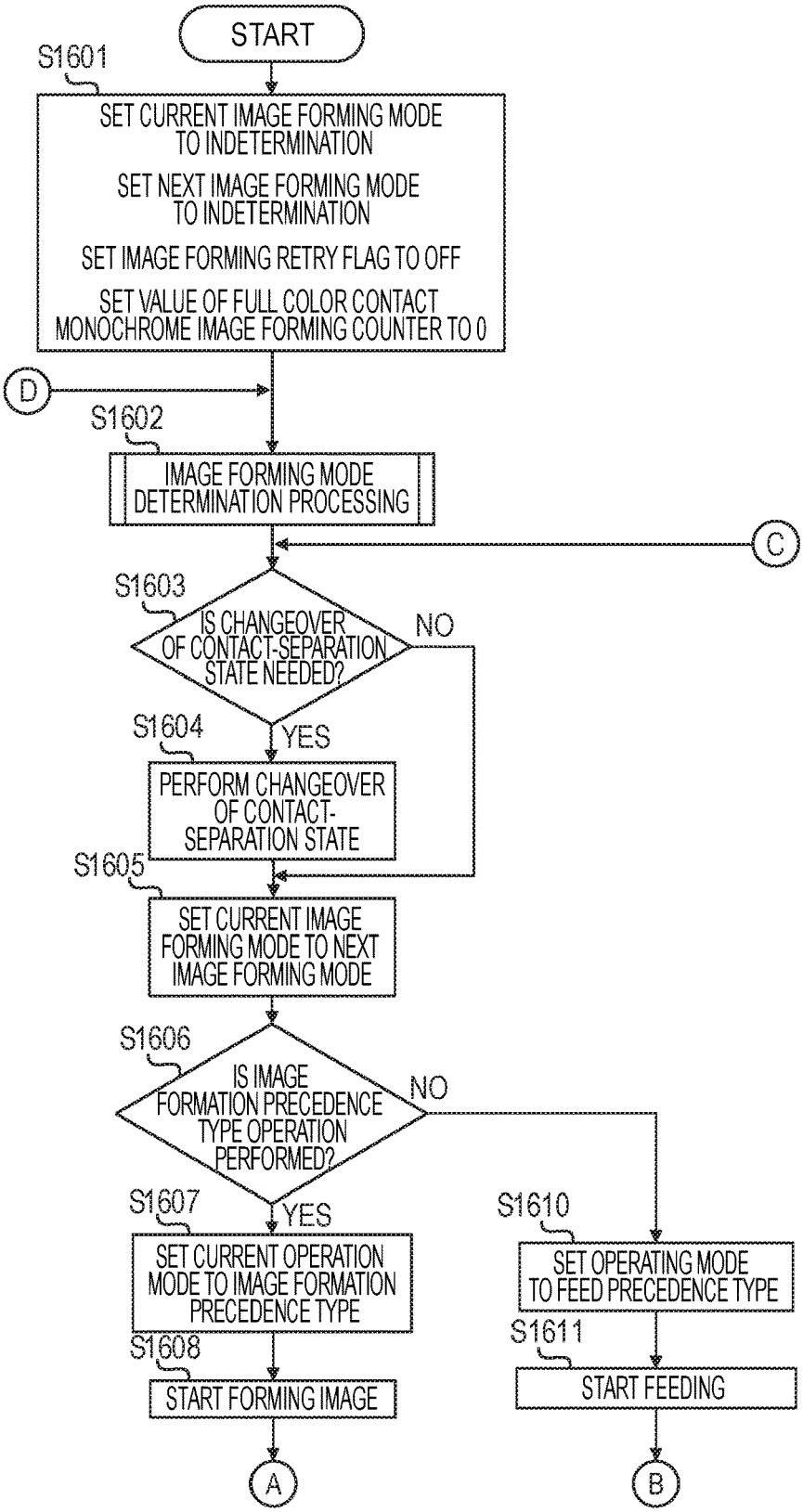
FIG. 16, which is composed of FIG. 16A and FIG. 16B, is a flowchart for illustrating a print operation of the image forming apparatus according to the first embodiment.
Figure 16B:
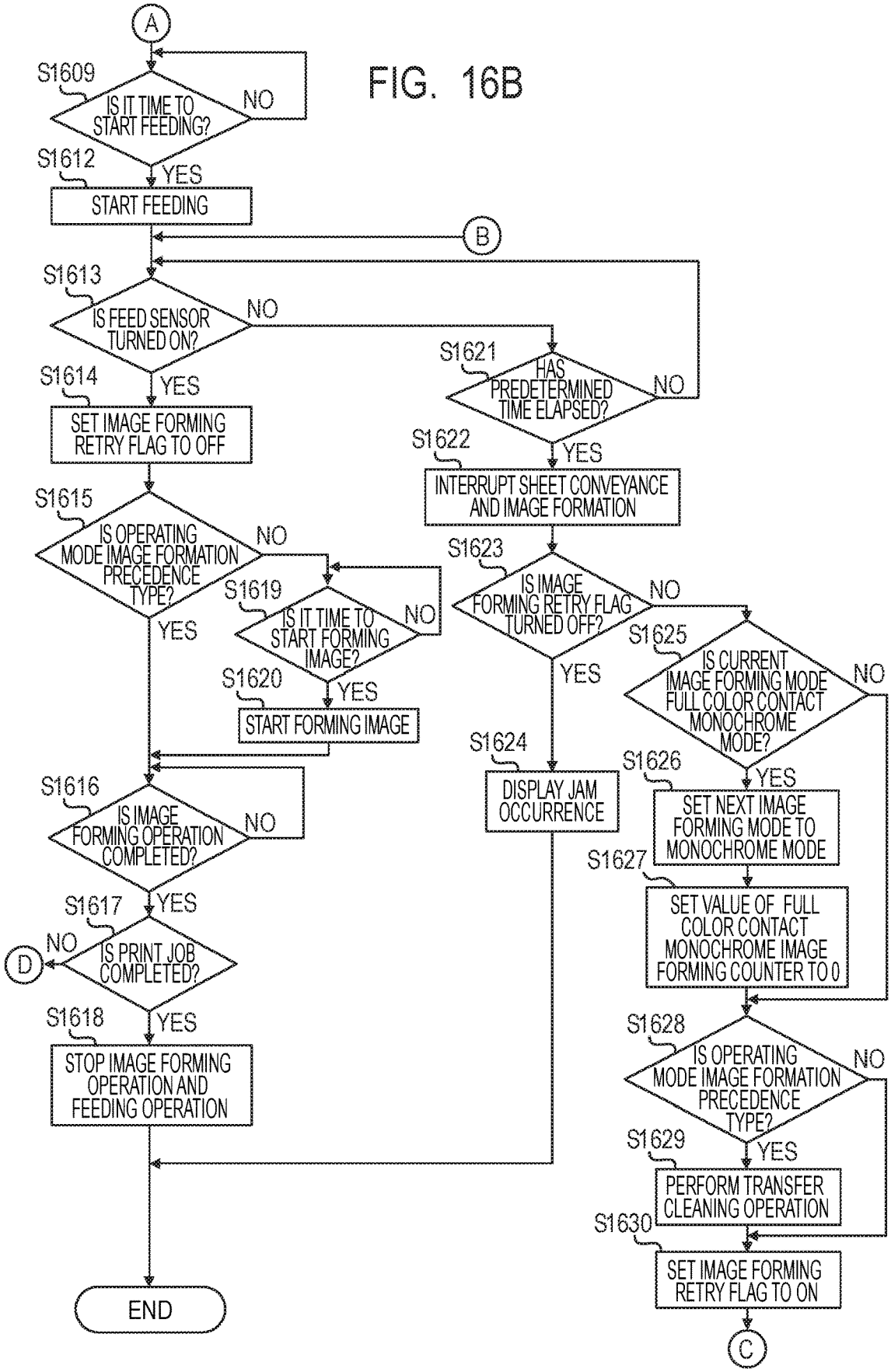

FIG. 16 is a flowchart for illustrating a print operation of the image forming apparatus 100 according to the first embodiment. The CPU 301 performs the print operation in accordance with a program stored in the ROM 302. The CPU 301 receives a start instruction for the print operation through pressing on the start key 306 or through an external IF 282 from the computer 283. When the print operation is started, the CPU 301 sets the current image forming mode and the next image forming mode stored in the RAM 303 to indetermination, sets the image forming retry flag to OFF, and sets a value of the full color contact monochromatic image forming counter to 0 (Step S1601). The CPU 301 performs the image forming mode determination processing in accordance with the flowchart illustrated in FIG. 9 (Step S1602) to set the next image forming mode.

The CPU 301 determines whether or not changeover of the contact-separation state of the intermediate transfer unit 140 is needed (Step S1603). Specifically, the CPU 301 refers to the current image forming mode and the next image forming mode stored in the RAM 303. When the current image forming mode is the monochrome mode, and the next image forming mode is a mode other than the monochrome mode, or when the current image forming mode is a mode other than the monochrome mode, and the next image forming mode is the monochrome mode, the CPU 301 determines that changeover of the contact separation state is needed (YES in Step S1603). The CPU 301 drives the contact-separation motor 504 to perform the changeover operation for the contact-separation state of the intermediate transfer unit 140 (Step S1604). Meanwhile, when the changeover of the contact-separation state is not needed (NO in Step S1603), the CPU 301 does not perform the changeover operation for the contact-separation state and proceeds to Step S1605.

The CPU 301 sets the current image forming mode to the next image forming mode (Step S1605). In accordance with the search table shown in FIG. 12 stored in the ROM 302, the CPU 301 determines whether or not the current operation mode is of the image formation precedence type (Step S1606). When the operation of the image formation precedence type is to be performed (YES in Step S1606), the CPU 301 sets the current operation mode stored in the RAM 303 to the image formation precedence type (Step S1607). The CPU 301 starts the image forming operation (Step S1608). The CPU 301 determines whether or not it is the time to start feeding (Step S1609). When it is the time to start feeding (YES in Step S1609), the CPU 301 drives the conveyance motor 276 by the recording medium conveying portion 270 to start feeding (Step S1612).

When the operation of the image formation precedence type is not to be performed (NO in Step S1606), the CPU 301 sets the operation mode stored in the RAM 303 to the feed precedence type (Step S1610). The CPU 301 starts feeding by the recording medium conveying portion 270 through the printer control portion 285 (Step S1611). After feeding is started (Step S1611 or Step S1612), the CPU 301 determines whether or not the feed sensor 109 provided downstream of the feed roller 114 is turned on (Step S1613). When the feed sensor 109 is turned on (YES in Step S1613), the sheet conveyance delay does not occur, and hence the CPU 301 sets the image forming retry flag stored in the RAM 303 to OFF (Step S1614). The CPU 301 determines whether or not the operation mode stored in the RAM 303 is the image formation precedence type (Step S1615). When the operation mode is the image formation precedence type (YES in Step S1615), the CPU 301 determines whether or not the image forming operation is completed (Step S1616). When the image forming operation is not completed (NO in Step S1616), the CPU 301 waits until the image forming operation is completed (Step S1616).

When the operation mode is not the image formation precedence type (NO in Step S1615), the CPU 301 determines whether or not it is the time to start forming an image (Step S1619). When it is the time to start forming an image (YES in Step S1619), the CPU 301 controls the image forming portion 271 to start forming an image (Step S1620). The CPU 301 determines whether or not the image forming operation is completed (Step S1616). When the image forming operation is not completed (NO in Step S1616), the CPU 301 waits until the image forming operation is completed (Step S1616).

When the image forming operation is completed (YES in Step S1616), the CPU 301 determines whether or not a print job is completed (Step S1617). When the print job is completed (YES in Step S1617), the CPU 301 controls the image forming portion 271 to complete the image forming operation, and controls the recording medium conveying portion 270 and the fixing portion to complete the conveyance operation (Step S1618). The print operation is completed. Meanwhile, when the print job is not completed (NO in Step S1617), the CPU 301 performs the image forming mode determination processing with respect to an image of the next page (Step S1602).

Meanwhile, when the feed sensor 109 is not turned on (NO in Step S1613), the CPU 301 determines whether or not a predetermined time period has elapsed (Step S1621). When the predetermined time period has not elapsed (NO in Step S1621), the CPU 301 waits for the feed sensor 109 to be turned on before elapse of the predetermined time period (Step S1613 and Step S1621). When the predetermined time period has elapses while the feed sensor 109 is not turned on (YES in Step S1621), the sheet conveyance delay occurs. Therefore, the CPU 301 performs interruption of the image forming operation and interruption of the sheet conveyance operation (Step S1622).

The CPU 301 determines whether or not the image forming retry flag stored in the RAM 303 is turned on (Step S1623). When the image forming retry flag is turned on (YES in Step S1623), the sheet conveyance delay has occurred twice successively. Therefore, the CPU 301 displays occurrence of the jam on the display portion 311 of the UI 330 (Step S1624). The print operation is completed. Meanwhile, when the image forming retry flag is not turned on (NO in Step S1623), the CPU 301 determines whether or not the current image forming mode stored in the RAM 303 is the full color contact monochrome mode (Step S1625). When the current image forming mode is not the full color contact monochrome mode (NO in Step S1625), the CPU 301 determines whether or not the operation mode stored in the RAM 303 is the image formation precedence type (Step S1628). Meanwhile, when the current image forming mode is the full color contact monochrome mode (YES in Step S1625), in order to prevent continuation of the full color contact monochrome mode, the CPU 301 sets the next image forming mode stored in the RAM 303 to the monochrome mode (Step S1626). The CPU 301 sets a value of the full color contact monochromatic image forming counter stored in the RAM 303 to 0 (Step S1627).

The CPU 301 determines whether or not the operation mode stored in the RAM 303 is the image formation precedence type (Step S1628). When the operation mode stored in the RAM 303 is the image formation precedence type (YES in Step S1628), the CPU 301 performs the transfer cleaning operation described above with reference to FIG. 10A, FIG. 10B, and FIG. 10C (Step S1629). Toner adheres to the secondary transfer outer roller 119 due to interruption of the sheet conveyance and the image formation in Step S1622. Therefore, the secondary transfer outer roller 119 is cleaned by the transfer cleaning operation. When the transfer cleaning operation is completed, the CPU 301 sets the image forming retry flag stored in the RAM 303 to ON (Step S1630). The processing returns to Step S1603. Meanwhile, when the operation mode stored in the RAM 303 is not the image formation precedence type (NO in Step S1628), the CPU 301 sets the image forming retry flag stored in the RAM 303 to ON without performing the transfer cleaning operation (Step S1630). The processing returns to Step S1603.

In the first embodiment, when the image forming retry operation is to be performed in the full color contact monochrome mode, changeover processing of changing over to the monochrome mode is performed before formation of the monochromatic image by the image forming retry operation, and image formation is restarted after completion of the changeover processing. With this, as compared to the case in which the operation is performed in the full color contact monochrome mode even after the image forming retry operation, the drive time of the photosensitive drums 101Y, 101M, and 101C is reduced, thereby preventing reduction in lifetime of the photosensitive drums 101Y, 101M, and 101C.

According to the first embodiment, when the image forming retry operation is to be performed in the full color contact monochrome mode, determination can be made on whether or not the full color contact monochrome mode is to be changed over to the monochrome mode before the image formation is restarted. However, the present invention is not limited to this. When the image forming retry operation is to be performed in the full color contact monochrome mode, without determination on whether or not to change over the full color contact monochrome mode to the monochrome mode, the full color contact monochrome mode may be changed over to the monochrome mode before the image formation is restarted.

According to the first embodiment, when the conveyance delay of the recording medium occurs during the image forming operation in the full color contact monochrome mode, the operation mode can be changed over from the full color contact monochrome mode to the monochrome mode before the image formation is restarted.

Second Embodiment

Now, a description will be provided of a second embodiment of the present invention. In the second embodiment, the structures which are the same as those of the first embodiment are denoted by the same reference symbols, and description thereof is omitted. The image forming system 500, the image forming apparatus 100, the UI 330, the intermediate transfer unit 140, and the contact-separation mechanism 400 in the second embodiment are the same as those of the first embodiment, and hence description thereof is omitted. In the first embodiment, when the image forming retry operation is to be performed in the full color contact monochrome mode, the changeover operation of changing over the contact-separation state of the intermediate transfer unit 140 is performed after completion of the transfer cleaning operation. In contrast, in the second embodiment, the transfer cleaning operation is performed after completion of the changeover operation of changing over the contact-separation state of the intermediate transfer unit 140. Now, the features which are different from those of the first embodiment are mainly described.

(Image Forming Retry Operation in Full Color Contact Monochrome Mode)

Figure 17A:
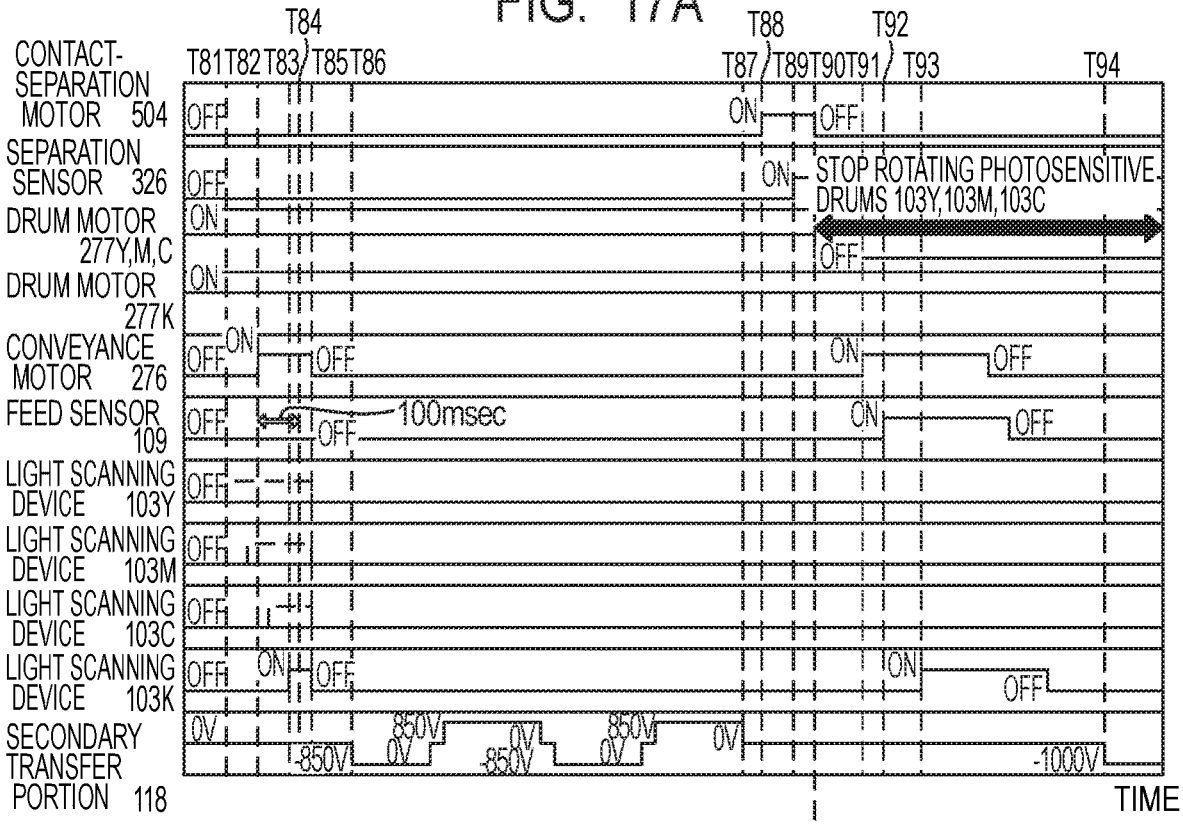
FIG. 17A is a timing chart for illustrating the image forming retry operation in the first embodiment.
Figure 17B:
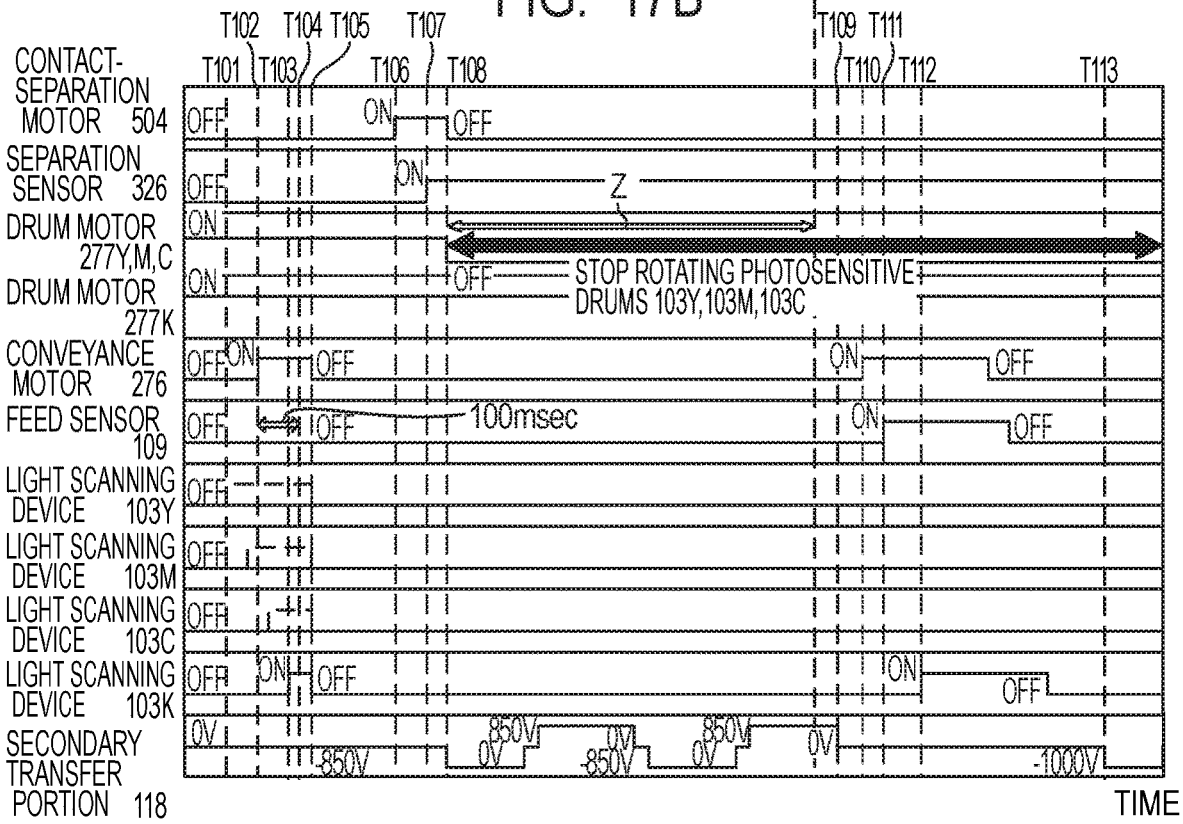
FIG. 17B is a timing chart for illustrating an image forming retry operation in a second embodiment.

FIG. 17A is a timing chart for illustrating the image forming retry operation in the first embodiment, and FIG. 17B is a timing chart for illustrating an image forming retry operation in the second embodiment. FIG. 17A and FIG. 17B are each illustrations of operation timings of the contact-separation motor 504, the separation sensor 326, the drum motors 277Y, 277M, 277C, and 277K, the conveyance motor 276, the feed sensor 109, the light scanning devices 103Y, 103M, 103C, and 103K, and the secondary transfer portion 118. FIG. 17A is a timing chart for illustrating the image forming retry operation in the full color contact monochrome mode in the first embodiment, and is the same as FIG. 14B described above.

FIG. 17B is a timing chart for illustrating the image forming retry operation in the full color contact monochrome mode in the second embodiment. At the turn-on timing (T101) of the light scanning device 103Y, the light scanning device 103Y is not turned on, and conveyance of a sheet by the conveyance motor 276 is started (T102). After that, only the light scanning device 103K is turned on (T103), and formation of a monochromatic image is started. However, the sheet conveyance delay occurs (T104), and the CPU 301 interrupts the sheet conveyance and the image forming operation (T105). In the second embodiment, before the transfer cleaning operation is started, the state of the intermediate transfer unit 140 is changed over from the contact state to the separation state. The CPU 301 drives the contact-separation motor 504 (T106) to change over the state of the intermediate transfer unit 140 from the contact state to the separation state. When the ON signal of the separation sensor 326 is detected (T107), the CPU 301 determines that the intermediate transfer unit 140 is in the separation state. The CPU 301 stops the contact-separation motor 504, stops the drum motors 277Y, 277M, and 277C, and further starts the transfer cleaning operation (T108). When the transfer cleaning operation is completed (T109), the CPU 301 drives the feed roller 114 by using the conveyance motor 276 (T110) to restart the conveyance of the sheet. When the feed sensor 109 is turned on within a predetermined time period (T111), the CPU 301 continues the conveyance of the sheet. In order to re-form the image supposed to be formed at T103, the CPU 301 turns on only the light scanning device 103K (T112) to start formation of the monochromatic image. After that, at the timing at which the sheet is conveyed to the secondary transfer portion 118 by the recording medium conveying portion 270, the CPU 301 applies the secondary high voltage to the secondary transfer outer roller 119 (T113) to transfer a toner image on the intermediate transfer belt 130 to the sheet.

In the first embodiment, as illustrated in FIG. 17A, after completion of the transfer cleaning operation (T87), the contact-separation motor 504 is driven (T88) to change over the state of the intermediate transfer unit 140 from the contact state to the separation state. After that, until the ON signal of the separation sensor 326 is detected (T89) and the contact-separation motor 504 is stopped (T90), rotation of the photosensitive drums 101Y, 101M, and 101C is continued. Meanwhile, in the second embodiment, as illustrated in FIG. 17B, after interruption of the image forming operation (T105) and before start of the transfer cleaning operation (T108), the state of the intermediate transfer unit 140 is changed over from the contact state to the separation state (T106). At the timing at which the changeover operation for the state of the intermediate transfer unit 140 is completed (T108), the drive of the photosensitive drums 101Y, 101M, and 101C is stopped. Therefore, as compared to the first embodiment, the rotation time of the photosensitive drums 101Y, 101M, and 101C is shortened by the interval Z illustrated in FIG. 17B, thereby preventing reduction in lifetime.

(Image Forming Operation)

Figures 18, 18A:
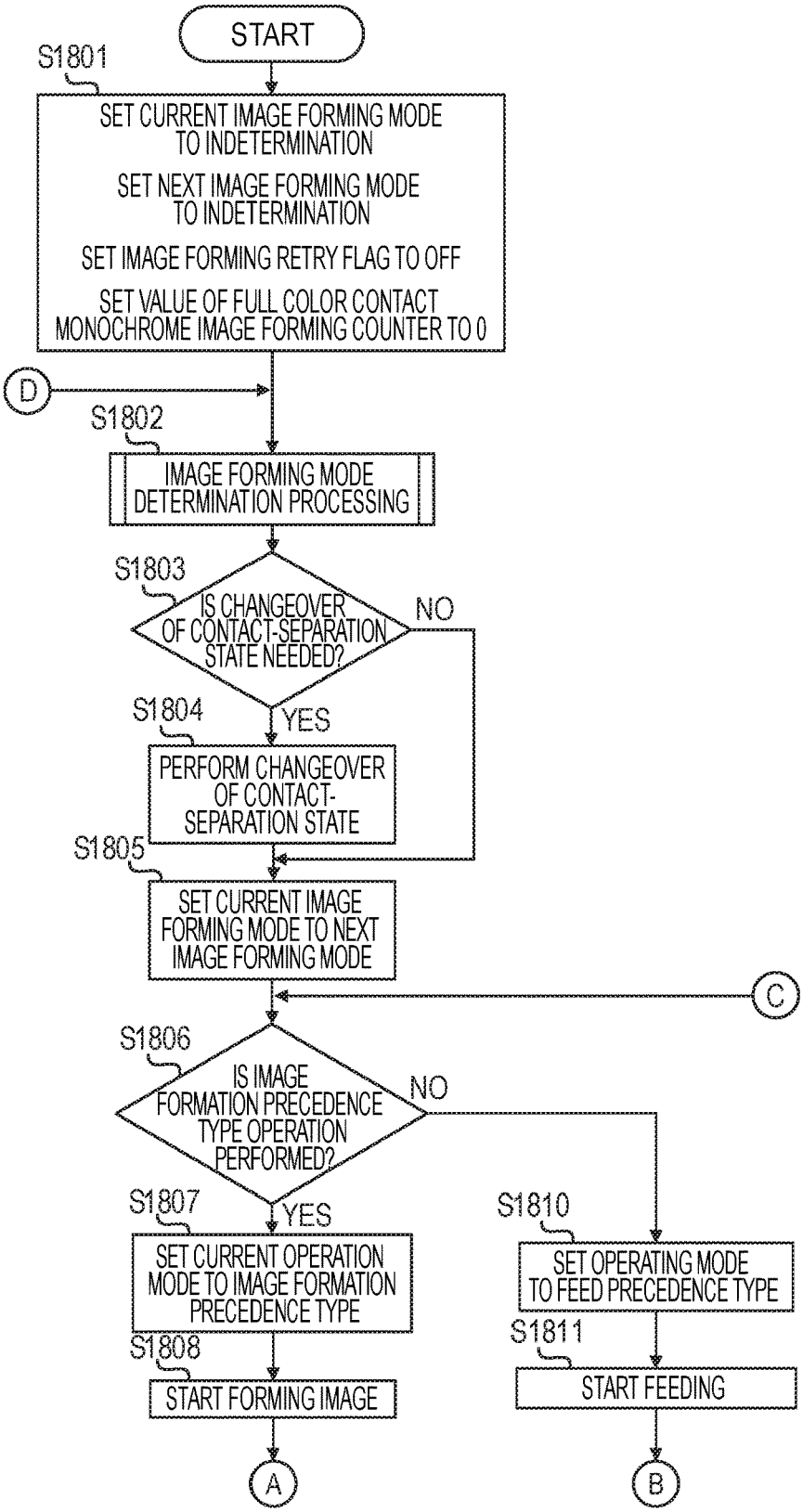
FIG. 18, which is composed of FIG. 18A and FIG. 18B, is a flowchart for illustrating a print operation of an image forming apparatus according to the second embodiment.
Figure 18B:
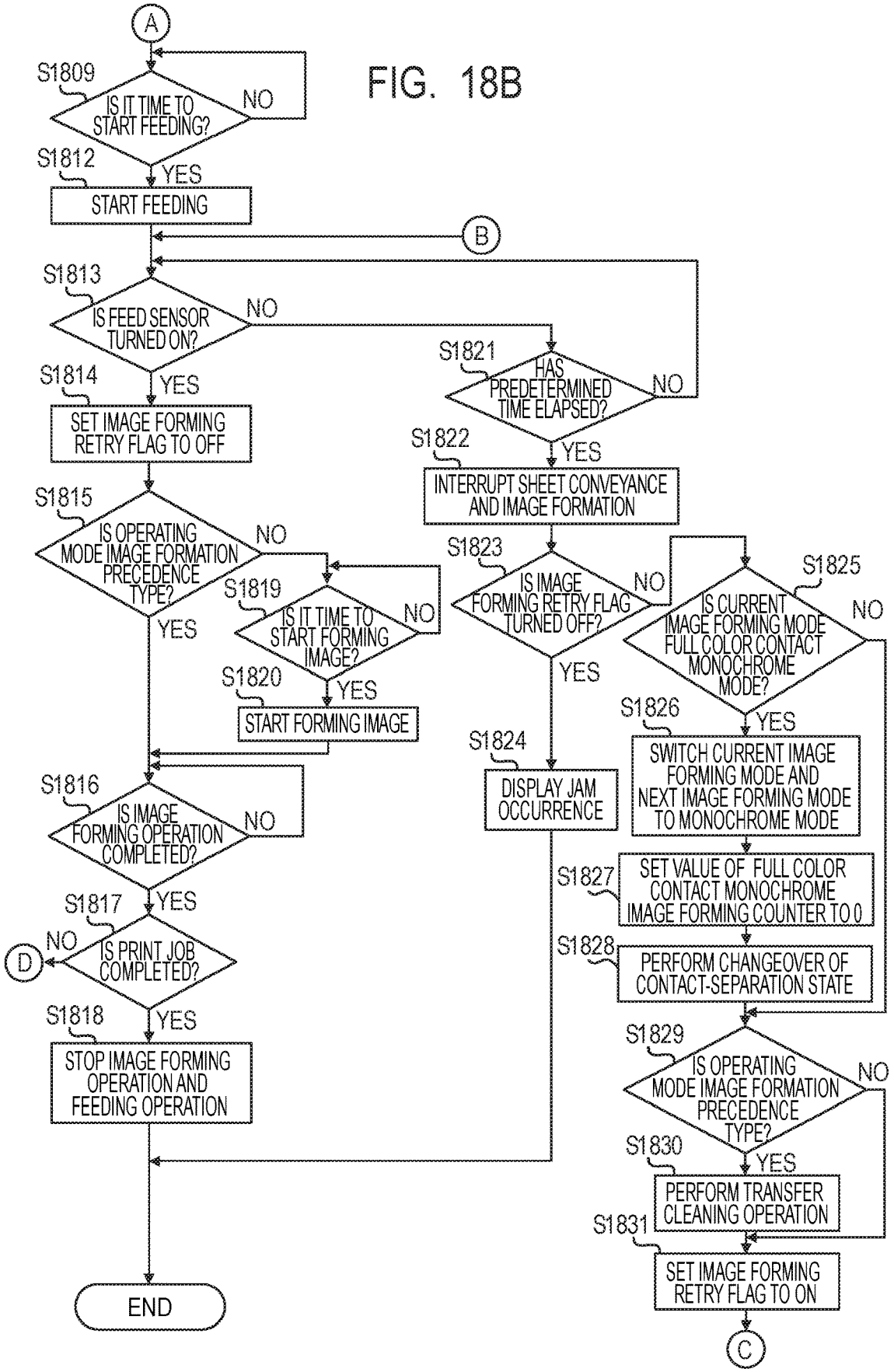

FIG. 18 is a flowchart for illustrating a print operation of the image forming apparatus 100 according to the second embodiment. The CPU 301 performs the print operation in accordance with the program stored in the ROM 302. The operations from Step S1801 to Step S1824 in FIG. 18 are the same as the operations from Step S1601 to Step S1624 in FIG. 16, and hence description thereof is omitted. When the image forming retry flag is not turned on (NO in Step S1823), in order to perform the image forming retry operation, the CPU 301 determines whether or not the current image forming mode stored in the RAM 303 is the full color contact monochrome mode (Step S1825). When the current image forming mode is not the full color contact monochrome mode (NO in Step S1825), the CPU 301 determines whether or not the operation mode stored in the RAM 303 is the image formation precedence type (Step S1829). Meanwhile, when the current image forming mode is the full color contact monochrome mode (YES in Step S1825), the CPU 301 changes over the current image forming mode stored in the RAM 303 and the next image forming mode to the monochrome mode (Step S1826). After that, the CPU 301 sets a value of the full color contact monochromatic image forming counter stored in the RAM 303 to 0 (Step S1827). The CPU 301 performs the changeover of the contact-separation state of the intermediate transfer unit 140 (Step S1828).

The CPU 301 determines whether or not the operation mode stored in the RAM 303 is the image formation precedence type (Step S1829). When the operation mode stored in the RAM 303 is the image formation precedence type (YES in Step S1829), the CPU 301 performs the transfer cleaning operation (Step S1830). Toner adheres to the secondary transfer outer roller 119 due to interruption of the sheet conveyance and the image formation in Step S1822. Therefore, the secondary transfer outer roller 119 is cleaned by the transfer cleaning operation. When the transfer cleaning operation is completed, the CPU 301 sets the image forming retry flag stored in the RAM 303 to ON (Step S1831). The processing returns to Step S1806. The CPU 301 again determines whether or not the current operation mode performs the image formation precedence type operation (Step S1806). Meanwhile, when the operation mode stored in the RAM 303 is not the image formation precedence type (NO in Step S1829), the CPU 301 sets the image forming retry flag stored in the RAM 303 to ON without performing the transfer cleaning operation (Step S1831). The processing returns to Step S1806.

In the second embodiment, when the image forming retry operation is to be performed in the full color contact monochrome mode, the changeover operation to the monochrome mode is performed before the transfer cleaning operation is performed. The image formation is restarted after completion of the transfer cleaning operation in the monochrome mode. With this, as compared to the case in which the transfer cleaning operation is performed in the full color contact monochrome mode, the drive time of the photosensitive drums 101Y, 101M, and 101C is reduced. Therefore, reduction in lifetime of the photosensitive drums 101Y, 101M, and 101C can be prevented.

In the second embodiment, the time from suspension of the image forming operation to stop of the drive of the photosensitive drum 101 is shorter than that of the first embodiment by the interval Z illustrated in FIG. 17B. The toner which remains on the photosensitive drum 101 at the time of suspension of the image forming operation is collected by the photosensitive drum cleaner 107 through the drive of the photosensitive drum 101. However, when the drum cleaning time from the timing of suspension of the image forming operation (T105) to the timing of stopping the drive of the color photosensitive drum 101 (T108) is short, the toner on the photosensitive drum 101 cannot be sufficiently collected. Therefore, when the drum cleaning time is excessively short so that toner on the photosensitive drum 101 cannot be sufficiently collected, the image forming retry operation of the first embodiment is performed. Meanwhile, when the drum cleaning time is sufficiently long so that the toner on the photosensitive drum 101 can be sufficiently collected, the image forming retry operation of the second embodiment is performed.

According to the second embodiment, when the conveyance delay of the recording medium occurs during the image forming operation in the full color contact monochrome mode, the operation mode can be changed from the full color contact monochrome mode to the monochrome mode before the image formation is restarted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-198316, filed Oct. 12, 2017, which is hereby incorporated by reference herein in its entirety.

What is claimed is:

1. An image forming apparatus, comprising:

a storage unit configured to store a recording medium;

a feeding unit configured to feed the recording medium from the storage unit;

a first photosensitive drum on which a color toner image is to be formed;

a second photosensitive drum on which a black toner image is to be formed;

an intermediate transfer member to which the color toner image and the black toner image are to be transferred;

a transfer portion configured to transfer the toner images having been transferred on the intermediate transfer member to the recording medium;

a mechanism configured to bring the intermediate transfer member into a first state in which the intermediate transfer member is in contact with the first photosensitive drum and the second photosensitive drum and a second state in which the intermediate transfer member is separated from the first photosensitive drum and in contact with the second photosensitive drum;

a detector configured to detect the recording medium fed by the feeding unit; and a controller, wherein the image forming apparatus is operable in:

a first image forming mode of bringing the intermediate transfer member into the first state and forming an image by using the first photosensitive drum and the second photosensitive drum;

a second image forming mode of bringing the intermediate transfer member into the second state and forming an image by using only the second photosensitive drum; and a third image forming mode of bringing the intermediate transfer member into the first state and forming an image by using only the second photosensitive drum, and wherein the controller is configured to:

determine an occurrence of a recording medium conveyance delay in which a recording medium is not detected by the detector within a predetermined time period;

in a case in which the recording medium conveyance delay occurs, perform restarting a feeding operation by the feeding unit and perform an image forming retry involving an operation of cleaning the transfer portion; and in a case in which the image forming retry is to be performed in the third image forming mode, change over the third image forming mode to the second image forming mode without stopping rotation of the second photosensitive drum and perform an image formation on a recording medium fed by restart of the feeding operation after the third image forming mode is changed over to the second image forming mode.

2. An image forming apparatus according to claim 1, wherein, regardless of whether a next image subsequent to the image formed by the image forming retry is a monochromatic image or a full color image, the controller determines that the third image forming mode is to be changed over to the second image forming mode before the feeding operation and the image formation are restarted, and changes over the third image forming mode to the second image forming mode.

3. An image forming apparatus according to claim 1, wherein, in a case in which a next image subsequent to the image formed by the image forming retry is a monochromatic image, the controller determines that the third image forming mode is to be changed over to the second image forming mode before the feeding operation and the image formation are restarted, and changes over the third image forming mode to the second image forming mode.

4. An image forming apparatus according to claim 1, wherein, in a case in which a next image subsequent to the image formed by the image forming retry is a full color image, the controller determines that the third image forming mode is not to be changed over to the second image forming mode before the feeding operation and the image formation are restarted, and restarts the feeding operation and the image formation while maintaining the third image forming mode.

5. An image forming apparatus according to claim 1, further comprising:

a first light scanning device configured to emit a light beam to form an electrostatic latent image on a surface of the first photosensitive drum; and a second light scanning device configured to emit a light beam to form an electrostatic latent image on a surface of the second photosensitive drum, wherein the image forming apparatus is operable in:

an operation of an image formation precedence type in which start of a forming operation of forming the electrostatic latent image by the first light scanning device precedes the feeding operation of feeding the recording medium by the feeding unit; and an operation of a feed precedence type in which start of the feeding operation precedes the forming operation, and wherein the controller is configured to perform the operation of cleaning in the operation of the image formation precedence type.

6. An image forming apparatus according to claim 1, wherein the feeding unit comprises a feed roller, and wherein the recording medium conveyance delay occurs due to slipping of the feed roller.

7. An image forming apparatus according to claim 1, wherein, in a case in which the detector does not detect the recording medium even after performing the feeding operation a predetermined number of times, the controller determines that a jam occurs.

8. An image forming apparatus according to claim 1, wherein, in a case in which the detector does not detect the recording medium even after performing the feeding operation a predetermined number of times, the controller controls a display portion to display an error.

9. An image forming apparatus according to claim 1, wherein, in a case in which the detector does not detect the recording medium even after performing the feeding operation a predetermined number of times, the controller interrupts the image forming operation.

* * * * *